US006496156B1

(12) United States Patent
Lusignan et al.

(10) Patent No.: US 6,496,156 B1
(45) **Date of Patent: *Dec. 17, 2002**

(54) ANTENNA FEED HAVING CENTERLINE CONDUCTOR

(75) Inventors: Bruce B. Lusignan, Redwood City, CA (US); Arthur Karp, Palo Alto, CA (US); Tohru Takagi, Irvine, CA (US); Kazuo Hosono, San Jose, CA (US)

(73) Assignee: Mitsubishi Electric & Electronics USA, Inc., Cypress, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,640

(22) Filed: Oct. 6, 1998

(51) Int. Cl.[7] ..... H01Q 13/02; H01Q 19/19

(52) U.S. Cl. ..... 343/781 R; 343/781 P; 343/786

(58) Field of Search ..... 343/786, 781 P, 343/781 R, 840; H01Q 13/02

(56) References Cited

U.S. PATENT DOCUMENTS 2,307,011 A * 1/1943 Barrow ..... 343/786
4,504,836 A * 3/1985 Seavey ..... 343/786
4,584,588 A * 4/1986 Mohring et al. ..... 343/786
4,679,249 A * 7/1987 Tanaka et al. ..... 333/21 R
4,827,277 A * 5/1989 Becker et al. ..... 343/781 P
4,996,535 A * 2/1991 Profera ..... 343/786
5,086,303 A * 2/1992 Usai et al. ..... 343/786
5,216,432 A * 6/1993 West ..... 343/786

* cited by examiner

*Primary Examiner*—Michael C. Wimer

(57) ABSTRACT

An antenna feed horn assembly includes a circular feed horn having an electrically conductive wall with an edge defining a circular aperture. The antenna feed horn assembly further includes a circular waveguide mounted to the base of the circular feed horn and including an endplate. An cylindrical rod extends from the center of the endplate towards the center of the feed horn aperture along a longitudinal axis of the antenna feed horn assembly to minimize undesired reflections produced by transitions between electrically conductive material and non-electrically conductive material or dielectric within the antenna feed horn assembly. An antenna feed horn assembly can also include a splash plate opposite the endplate, the center from which another cylindrical rod extends towards the center of the endplate along the longitudinal axis of the antenna feed horn assembly to further minimize undesired reflections.

4 Claims, 19 Drawing Sheets

ANTENNA FEED HAVING CENTERLINE CONDUCTOR

FIELD OF THE INVENTION

The present invention pertains to RF receiving antennas, including feeds for such antennas.

BACKGROUND OF THE INVENTION

A typical known receiving antenna includes a parabolic reflector and a corresponding feed horn to guide energy received from a transmitting antenna into a circular waveguide. The energy propagates through the waveguide to an orthomode transducer, which simultaneously extracts horizontally and vertically polarized energy. Such antennas are used in many microwave communications applications, including ground relays and geosynchronous communications satellites, which simultaneously transmit both vertically polarized linear signals and horizontally polarized linear signals on the same frequency allocation. In such applications, it is advantageous to use a receiving antenna that can simultaneously receive both of the respective polarizations, thereby reducing cost complexity and minimizing the space required at the facility at which the receiving antenna is installed.

Referring to FIG. 1, a known Newtonian feed antenna system 20 is configured to receive respective horizontally and vertically polarized signals 22 and 24 from a geosynchronous communications satellite transmitter (not shown) along an axis 26 of the antenna 20. The antenna system 20 generally includes a true parabolic reflector 28 and a feed assembly 30. The reflector 28 includes a parabolic arc, which causes the respective signals 22 and 24 to reflect from the surface of the reflector 28 towards a focal point 32, as best depicted in FIG. 2. The feed assembly 30 includes a circular feed horn 34, circular waveguide 36 and orthomode transducer (not shown). The feed assembly 30 is supported by a feed assembly support 38, such that the feed horn 34 is supported at the focal point 32. Thus, the respective signals 22 and 24 that are directed towards the focal point 32 from the reflector 28 are conveyed down the feed horn 34 to the waveguide 36, where they are extracted by the orthomode transducer for processing by further receiving circuitry (not shown). In this manner, a single feed antenna is provided with dual-polarization capability.

The dual polarization capability of the antenna 20, however, presents a problem in that the E-field of a linearly polarized energy distribution across the aperture of a typical feed horn is different in respective vertical and horizontal planes. FIG. 4 shows a vertically polarized E-field 46 at an aperture 42 defined by a rim 44 of the circular feed horn 34. For ease of illustration, the aperture 42 is depicted as having respective orthogonal X-, Y- and Z-axes, with the X- and Y-axes being coplanar with the aperture 42 and the Z-axis being perpendicular to and passing through the center of the aperture 42. As shown in FIG. 4A, the magnitude of the E-field 46 is fairly uniform along the X-axis (vertical plane) and terminates at full strength at the rim 44. As shown in FIG. 4B, the magnitude of the E-field 46 along the Y-axis (horizontal plane) is maximum at the Z-axis and terminates to zero at the rim 44.

As depicted in FIGS. 5A and 5B, the differing E-field 46 across the aperture 42 produces a horn radiation gain pattern 48 having a beam width ($\Theta X$) as measured in the vertical plane and a beam width ($\Theta Y$) as measured in the horizontal plane, which are respectively different. In the vertical plane, where the E-field 46 across the aperture is larger (from rim to rim), the resulting beam width ($\Theta X$) of the horn radiation gain pattern 48 is narrower. In the horizontal plane, where the E-field 40 across the aperture 42 is smaller (zero at each rim), the resulting beam width ($\Theta Y$) of the horn radiation gain pattern 48 is broader.

Referring to FIGS. 5A and 5B, the horn radiation gain pattern 48 produced by the feed horn 34 is directed towards the surface of the reflector 28 and appears on the reflector 28 in the form of a gain contour 50 (depicted in FIG. 6). The gain contour 50 represents an ideal level of equal gain, typically 1/100th of the peak gain, i.e., −20 dB from the peak gain. The gain contour 50 is optimally coextensive with a rim 52 of the reflector 28, such that the gain measured from the Z-axis to the rim 52 of the reflector 28 decreases gradually enough that the reflector 28 is fully utilized, while still increasing quickly enough that a substantial amount of energy is not radiated outside the reflector rim 52 and lost behind the reflector 28.

As depicted in FIG. 6, however, the gain contour 50 is not coextensive with the reflector rim 52. Rather, the gain contour 50 is elliptical in shape, the gain along the X-axis (vertical plane) to decrease too quickly, thereby "underfeeding" the reflector 28 along the X-axis. This mismatch also causes the gain along the Y-axis (horizontal plane) to decrease too gradually, thereby "overfeeding" the reflector 28 along the Y-axis. Because the reflector 28 is "underfed" along the vertical plane, a resulting reflector radiation gain pattern 54 along the vertical plane has a beam width ($\phi X$) that is too broad (as depicted in FIG. 7), producing a less than ideal antenna gain. Because the reflector 28 is "overfed" along the horizontal plane, the resulting reflector radiation gain pattern 54 along the horizontal plane has a beam width ($\phi Y$) that is relatively narrow (as depicted in FIG. 7), but a substantial amount of energy is lost behind the reflector 28, producing a less than ideal antenna gain.

Typically, the feed aperture 42 is sized to adjust the respective breadths of the horn radiation gain pattern 48 as measured in the respective vertical and horizontal planes, i.e., the size of the feed aperture 42 is increased or decreased to respectively narrow or broaden the horn radiation gain pattern 48 in both the vertical and horizontal planes. Because the feed aperture 42 is circular, however, the breadth of the horn radiation gain pattern cannot be adjusted independently for the respective vertical and horizontal planes. Instead, the ideal breadth of the horn radiation pattern in the respective planes and, thus, the ideal gain in the respective planes, must be compromised. Such a problem occurs not only in antenna assemblies such as the antenna system 20, but in any antenna system that employs a circular feed horn to receive a linearly polarized signal.

FIG. 8 depicts a rectangular feed horn 60, which addresses this problem. A vertically polarized E-field 66 is shown at an aperture 62 defined by a rectangular rim 64 of the feed horn 60. For ease of illustration, the aperture 62 is depicted as having respective orthogonal X-, Y- and Z-axes, with the E-field 66 generally polarized parallel and perpendicular to the X- and Y-axes, respectively. The X- and Y-axes are generally coplanar with the aperture 62 and the Z-axis is generally perpendicular to and passes through the center of the aperture 62. As with the circular feed horn 34, the magnitude of the E-field 66 is fairly uniform along the X-axis (vertical plane) and terminates at full strength at the rim 64 (depicted in FIG. 8A), and the magnitude of the E-field along the Y-axis (horizontal plane) is maximum at the Z-axis and terminates to zero at the rim 64 (depicted in FIG. 8B).

Unlike the circular feed horn 34, however, the dimensions of the rectangular feed horn 60 can be adjusted to independently vary the breadth of the horn radiation gain pattern in the respective vertical and horizontal planes. That is, the feed horn 60 has dimensions (a) and (b) in the respective vertical and horizontal planes, which can be independently varied to adjust the horn radiation gain pattern in the respective vertical and horizontal planes. Although the E-field 66 along the horizontal plane terminates to zero at the rim 64, thereby generally creating a broad antenna radiation gain pattern along the horizontal plane, dimension (b) can be made greater than dimension (a) to narrow the antenna radiation gain pattern along the horizontal plane to more closely match the breadth of the antenna radiation gain pattern along the vertical plane. This results in a generally circularized antenna radiation gain pattern that can be more closely matched with a circular reflector.

Adjusting the respective dimensions (a) and (b) of the feed horn 60 to optimize a vertically polarized horn radiation gain pattern will have the opposite effect on a horizontally polarized horn radiation gain pattern, i.e., the horizontally polarized horn radiation gain pattern will become more elliptical. Therefore, adjusting the respective dimensions of a rectangular feed horn will not simultaneously optimize respective vertically and horizontally polarized horn radiation patterns. Thus, a rectangular feed horn is not a solution in a dual polarization application.

This dual polarization problem not only occurs in Newtonian feed antennas, but occurs in other designs as well. Referring to FIG. 9, a known antenna system 80, configured to receive respective first and second polarized signals 82 and 84, includes a ring focus parabolic main reflector 86 and a feed assembly 88. The main reflector 86 includes a parabolic arc that originates from a ring 90 offset from a longitudinal axis 92, which causes the respective signals 82 and 84 to reflect from the surface of the reflector 86 towards a focal ring 94, as best depicted in FIG. 3. The feed assembly 88 includes a circular secondary reflector or "splash plate" 96, a circular feed horn 98, a circular waveguide 100 and an orthomode transducer (not shown). The splash plate 96 is disposed above the focal ring 94, such that the respective signals 82 and 84 reflect off of the splash plate 96, down the feed horn 98 and into the circular waveguide 100, where they are extracted by the orthomode transducer for processing by further receiving circuitry (not shown).

As with the antenna 20, the antenna system 80 presents a problem in that the E-field of a linearly polarized energy distribution across the annular aperture between the feed horn and splash plate in a typical feed assembly is different in respective vertical and horizontal planes. FIG. 10 shows a vertically polarized E-field 102 at an aperture 106 defined by the rim of the circular feed horn 98. For ease of illustration, the annular aperture 104 is depicted as having an axis of revolution around which the angles 0°, 90°,180° and 270° are labeled. The E-field 102 is generally polarized along the respective 0° and 180° locations. As shown in FIG. 10A, the E-field 102 at the 90° and 270° locations peaks along the boundary of the annular aperture 104 and terminates to zero at the feed horn rim 106 and splash plate rim 108. As shown in FIG. 10B, the magnitude of the E-field 102 at the 0° and 180° locations is fairly uniform along the boundary of the annular aperture 104 and terminates at full strength at the feed horn rim 106 and splash plate rim 108.

Like the feed assembly 30 of the antenna 20, the feed assembly 88 produces a horn radiation gain pattern with different beam widths in orthogonal planes, resulting in an elliptical gain contour on the main reflector 86 and an inefficient reflector radiation gain pattern.

This problem becomes more significant when designing antennas in which the reflector energy distribution is critical, such as, e.g., multiple reflector noise cancellation antennas, the features of which are described in Lusignan, U.S. Pat. No. 5,745,084, and copending application Ser. No. 08/259,980, filed Jun. 17, 1994, both of which are fully incorporated herein by reference.

Another problem that occurs in the previously described antennas is the occurrence of unintended modes generated at sudden transitions in structures, such as, e.g., a splash plate, feed horn or waveguide. These transitions create unwanted modes that may couple energy from one polarization to another (cross-coupling) or impedance mismatch that may channel energy back out the feed (reflections) instead of guiding energy out through the orthomode transducer. If the length of the waveguide and the distance between the splash plate and the feed horn are relatively great, the deleterious results of the unintended modes will be small. For mechanical reasons, however, the antenna may be less expensive and more acceptable in its application if the feed horn is short. A shorter feed horn, however, can allow unintended modes to couple between sections of the feed and lead to loss and cross-coupling.

SUMMARY OF THE INVENTION

The present invention is directed to a circular antenna feed horn assembly in which there is disposed an electrical conductor along a longitudinal axis passing through the center of the feed horn assembly.

In a preferred embodiment, an antenna feed horn assembly includes a circular feed horn having an electrically conductive wall defining an aperture, and a circular waveguide mounted to a base of the circular feed horn and including an endplate opposite the circular aperture. An electrical conductor, and preferably, a slender cylindrical rod, extends from the center of the endplate towards the center of the circular aperture along the longitudinal axis. In this manner, unintended modes are minimized, thereby improving the performance of the antenna feed horn assembly.

In another preferred embodiment, an antenna feed horn assembly includes a circular feed horn and a splash plate disposed above the feed horn. The antenna feed horn assembly further includes a circular waveguide mounted to a base of the circular feed horn and including an endplate opposite the splash plate. A first electrical conductor, and preferably a slender cylindrical rod, extends from the center of the endplate towards the center of the splash plate along the longitudinal axis. A second electrical conductor, and preferably a slender cylindrical rod, extends from the center of the splash plate towards the center of the endplate along the longitudinal axis. In this manner, unintended modes are minimized, thereby improving the performance of the antenna feed horn assembly.

The normal desired modes of the circular waveguide do not include components of the E-field along the longitudinal axis while many of the unintended modes include such fields. Therefore, the slender rods along the longitudinal axis can reduce the deleterious effects of the unintended modes with little effect on the intended modes.

Other and further objects, features, aspects, and advantages of the present invention will become better understood with the following detailed description of the accompanying drawings.

BRIEF DESCRIPTION OF DRAWINGS

The drawings illustrate both the design and utility of preferred embodiments of the present invention, in which.

DETAILED DESCRIPTION OF THE DRAWINGS

Figure 1:
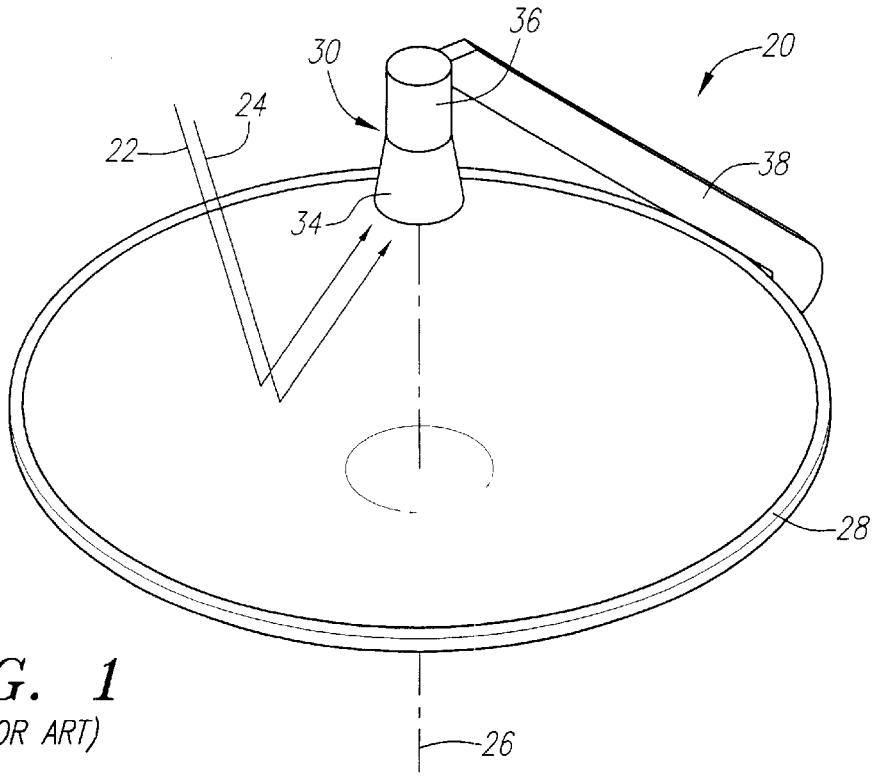
FIG. 1 (PRIOR ART)
FIG. 1 is a perspective view of a prior art Newtonian feed receiving antenna.
Figure 2:
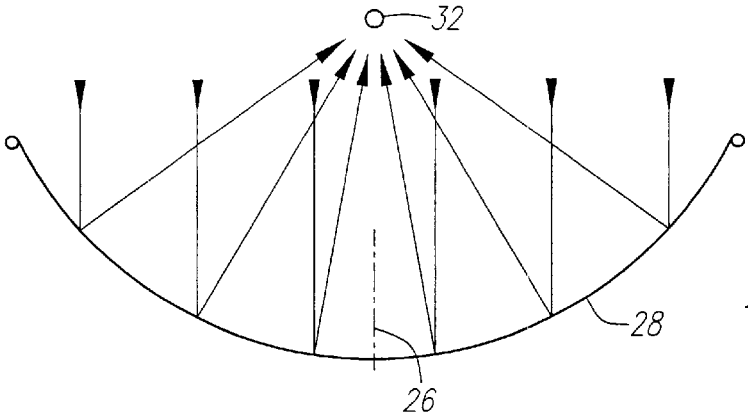
FIG. 2 (PRIOR ART)
FIG. 2 is a cut-away side view of a prior art true parabolic reflector showing the reflection of signals therefrom.
Figure 3:
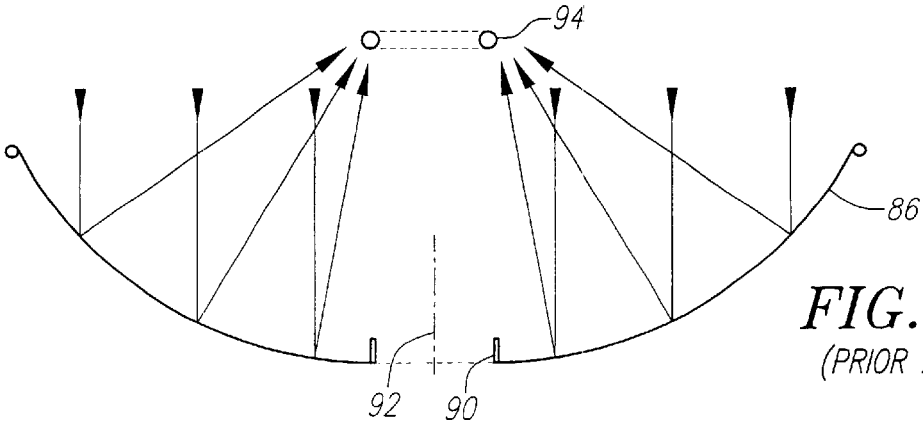
FIG. 3 (PRIOR ART)
FIG. 3 is a cut-away side view of a prior art ring focus parabolic reflector showing the reflection of signals therefrom.
Figure 11:
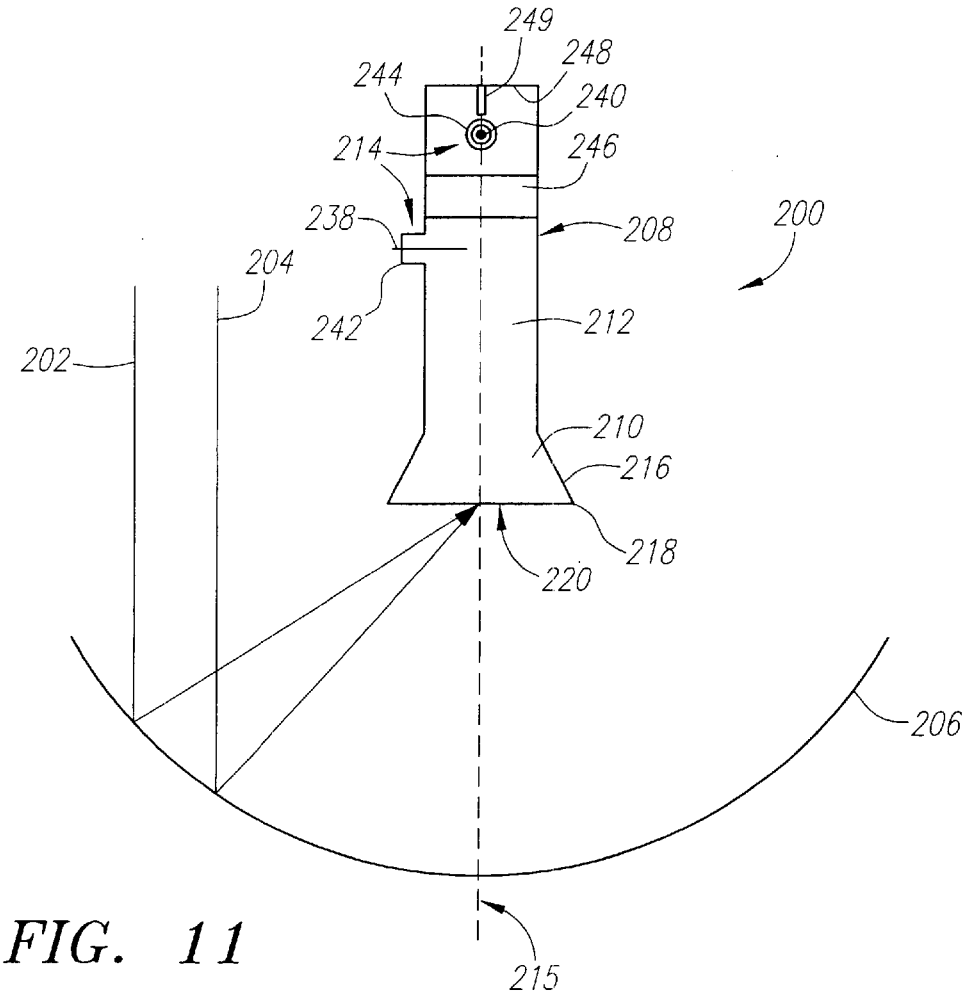
FIG. 11 is a cut-away side view of a Newtonian feed antenna constructed in accordance with the present invention.
Figure 12:
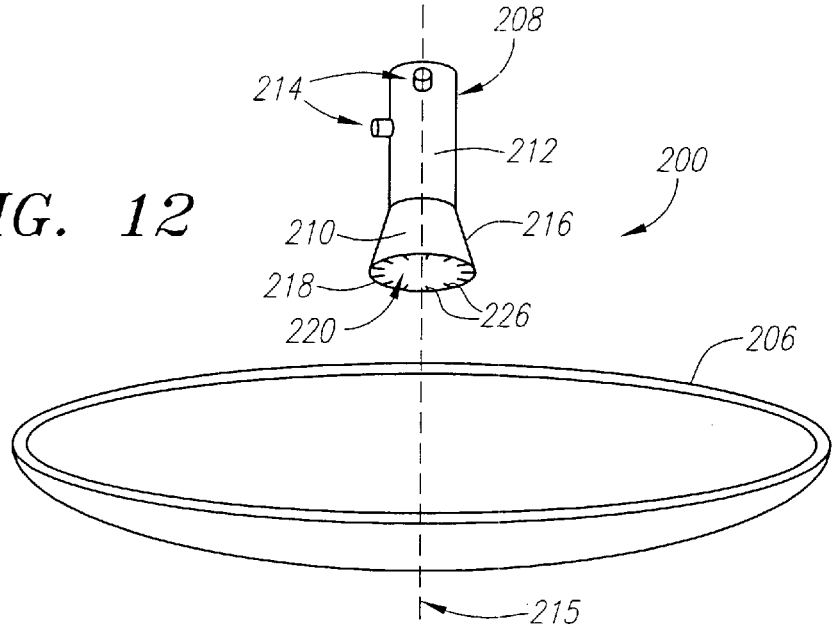
FIG. 12 is a perspective view of the Newtonian feed antenna of FIG. 11.

Referring to FIGS. 11 and 12, a Newtonian feed antenna system 200 designed in accordance with a preferred embodiment of the present invention is described. Like the antenna system 20 depicted in FIG. 1, the antenna system 200 is configured to receive respective polarized signals 202 and 204, and in this case, respective vertically and horizontally linear polarized signals. The antenna system 200 generally includes a parabolic reflector 206, a feed assembly 208 having a circular feed horn 210, circular waveguide 212 and orthomode transducer 214, and a feed assembly support (not shown) on which the feed assembly 208 is mounted. The reflector 206, feed horn 210 and waveguide 212 are all circularly symmetrical about an antenna axis 215. As such, the antenna system 200 will guide all polarizations in the same manner, whether vertical and horizontal linearly polarized or right-hand and left-hand circularly polarized.

Figure 4:
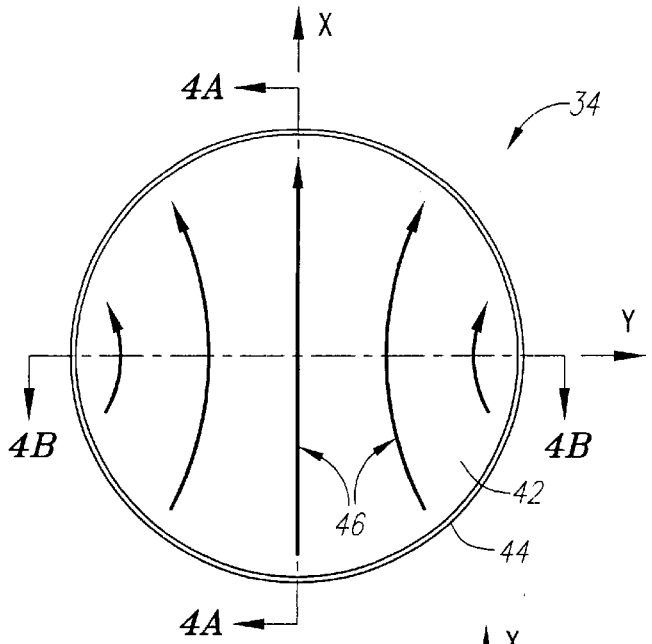
FIG. 4 (PRIOR ART)
FIG. 4 is a top view of a prior art circular feed horn forming a circular aperture with a vertically polarized electrical field ("E-field")
Figure 4A:
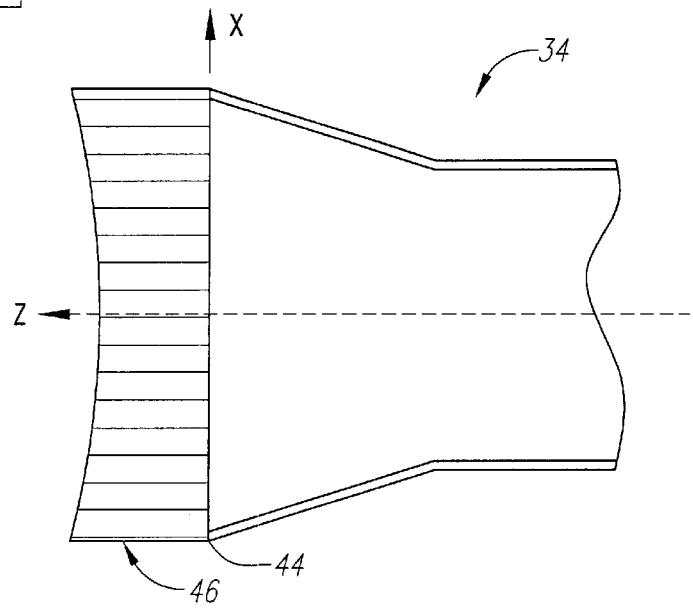
FIG. 4A (PRIOR ART)
FIG. 4A is a partial cut-away side view of the feed horn of FIG. 4 showing the magnitude of the vertically polarized E-field as measured along a vertical plane.
Figure 4B:
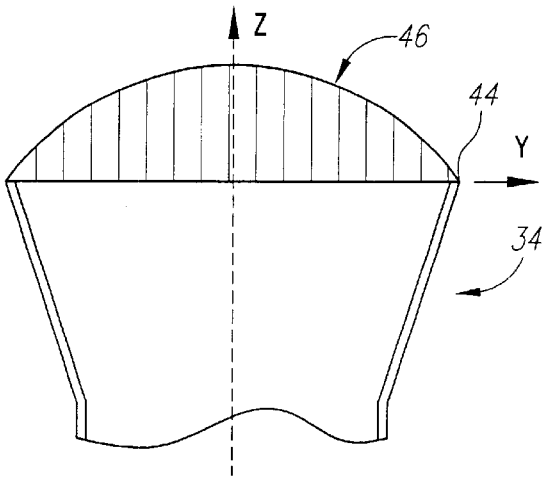
FIG. 4B (PRIOR ART)
FIG. 4B is a partial cut-away side view of the feed horn of FIG. 4 showing the magnitude of the vertically polarized E-field as measured along a horizontal plane.
Figure 5A:
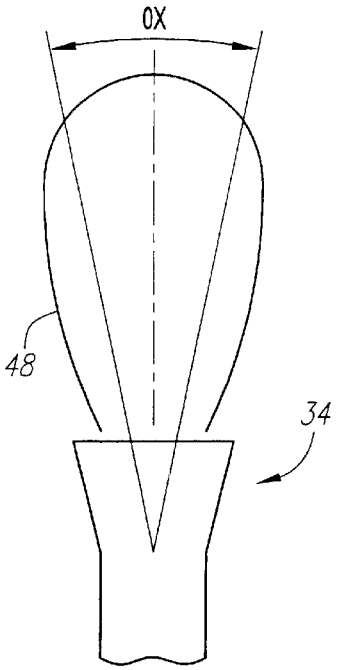
FIG. 5A (PRIOR ART)
FIG. 5A is a cut-away side view of the feed horn of FIG. 4 showing a gain pattern of E-plane polarized radiation as measured along that same plane.
Figure 5B:
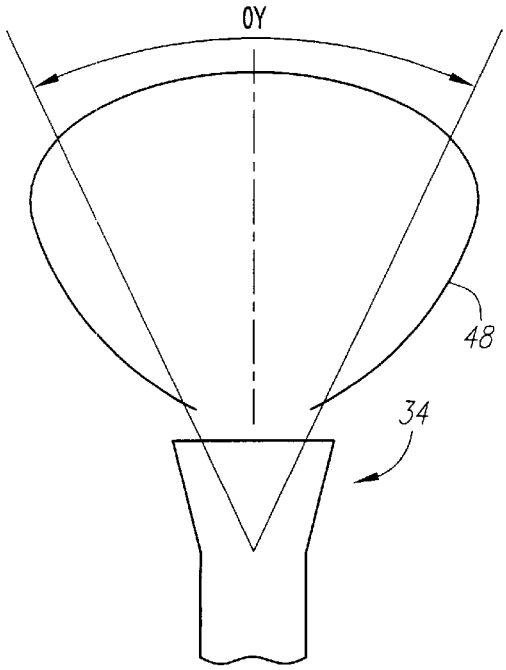
FIG. 5B (PRIOR ART)
FIG. 5B is a cut-away side view of the feed horn of FIG. 4 showing a gain pattern of E-plane polarized radiation as measured along that same plane.
Figure 6:
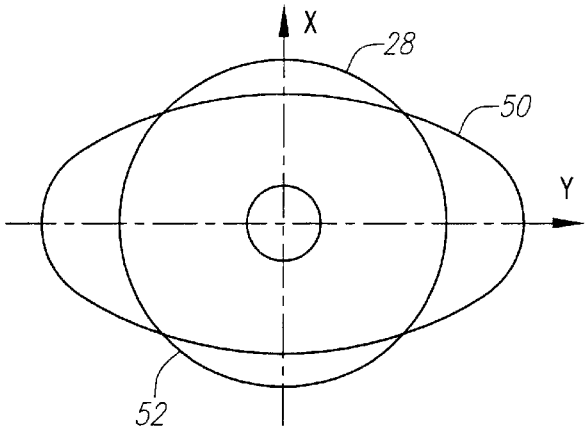
FIG. 6 (PRIOR ART)
FIG. 6 is a top view of the reflector of the antenna of FIG. 1 showing contours of E-plane polarized gain.
Figure 7:
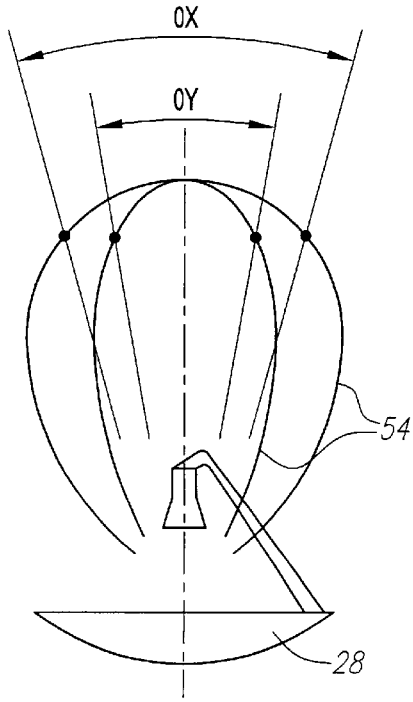
FIG. 7 (PRIOR ART)
FIG. 7 is a side view of the antenna of FIG. 1 showing an E-plane polarized antenna radiation gain pattern as respectively measured in the E- and H-planes.
Figure 8:
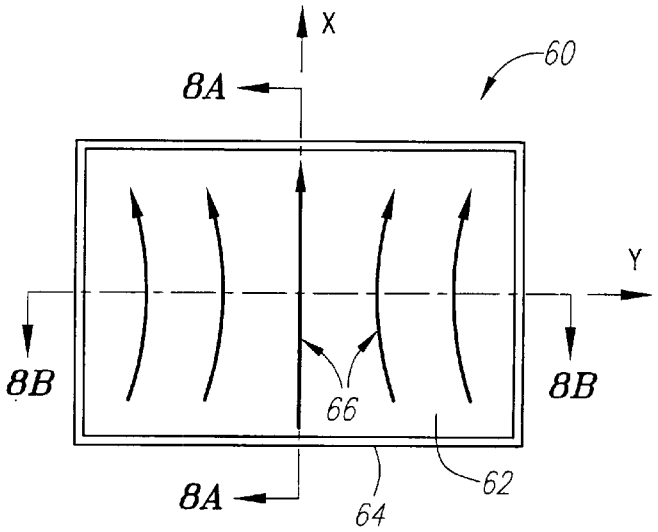
FIG. 8 (PRIOR ART)
FIG. 8 is a top view of a prior art rectangular horn forming a rectangular aperture with a vertically polarized E-field.
Figure 8A:
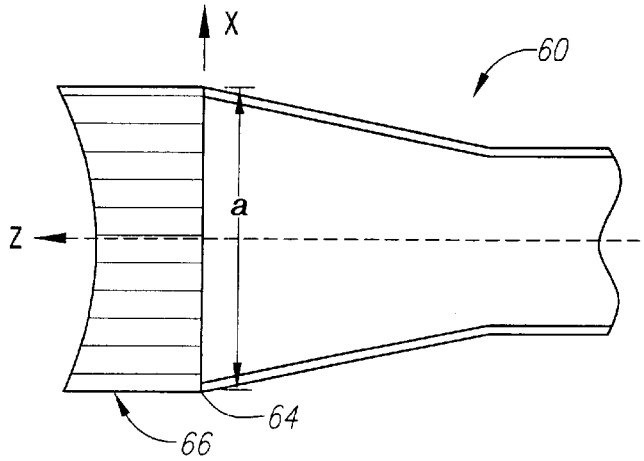
FIG. 8A (PRIOR ART)
FIG. 8A is a partial cut-away side view of the feed horn of FIG. 8 showing the magnitude of the vertically polarized E-field as measured along a vertical plane.
Figure 8B:
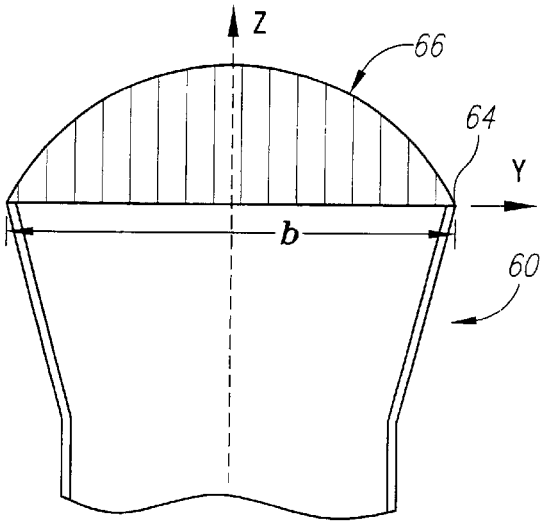
FIG. 8B (PRIOR ART)
FIG. 8B is a partial cut-away side view of the feed horn of FIG. 8 showing the magnitude of the vertically polarized E-field as measured along a horizontal plane.
Figure 13:
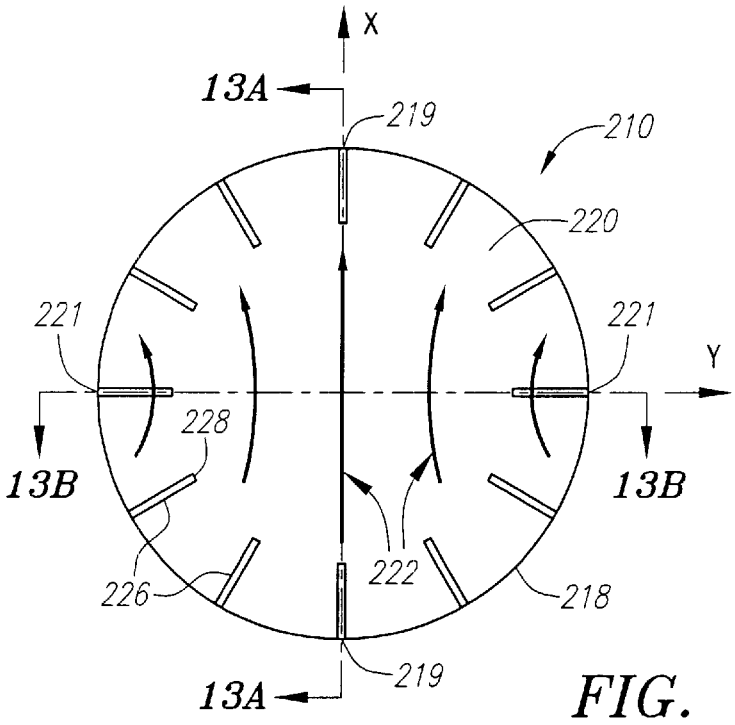
FIG. 13 is a top view of the circular feed horn of the antenna of FIG. 11 and forming a circular aperture with a vertically polarized E-field.
Figure 13A:
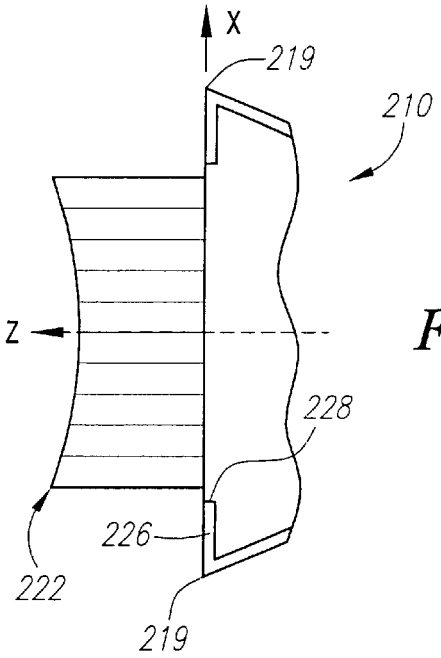
FIG. 13A is a partially cut-away side view of the circular feed horn of FIG. 13 showing the magnitude of the vertically polarized E-field as measured along a vertical plane.
Figure 13B:
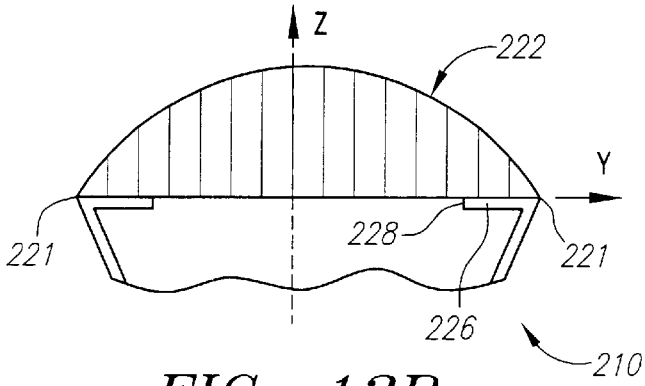
FIG. 13B is a partially cut-away side view of the circular feed horn of FIG. 13 showing the magnitude of the vertically polarized E-field as measured along a horizontal plane.

The feed horn 210 generally includes an electrically conducting conical wall 216 with an edge 218 forming a circular aperture 220 through which the respective signals 202 and 204 travel. FIG. 13 shows an electrical field ("E-field") 222 in the circular aperture 220 created by the vertically polarized signal 202, i.e., a vertically polarized E-field. For ease of illustration, the circular aperture 220 is depicted as having respective orthogonal X-, Y- and Z-axes, with the X- and Y-axes being coplanar with the circular aperture 220 and the Z-axis being perpendicular to and passing through the center of the circular aperture 220. Like the vertically polarized E-field 46 shown in the prior art feed horn aperture 42 of FIG. 4, the magnitude of the vertically polarized E-field 222 is fairly uniform along the X-axis (vertical plane) (depicted in FIG. 13A) and peaked along the Y-axis (horizontal plane) at the Z-axis (depicted in FIG. 13B).

The feed horn 210, however, further includes a plurality of electrical conductors 226, and in particular elongate tab structures, which extend from the edge 218 towards the center of the circular aperture 220 in a coplanar relationship with the circular aperture 220, with the elongate tab structures 226 differentially affecting the vertically polarized E-field 222. In particular, the vertically polarized E-field 222 terminates on a tip 228 of a tab structure when the edge 218 is perpendicular to the E-field 222 (depicted in FIG. 13A), whereas the vertically polarized E-field 222 is forced to zero value at the edge 218 when it is parallel to the E-field 222 (depicted in FIG. 13B). As such, the vertically polarized E-field 222 along the vertical plane terminate to full strength at the tab structure tips 228, rather than at the portions 219 of the edge 218. The vertically polarized E-field 222 along the horizontal plane, however, terminates to zero at the portions 221 of the edge 218. In this manner, although the aperture 220 is circularly symmetric, the effective diameters of the circular aperture 220 in the respective vertical and horizontal planes differ, i.e., the effective diameter of the circular aperture 220 in the vertical plane is smaller than the effective diameter of the circular aperture 220 in the horizontal plane with respect to the vertically polarized E-field 222.

Figure 14A:
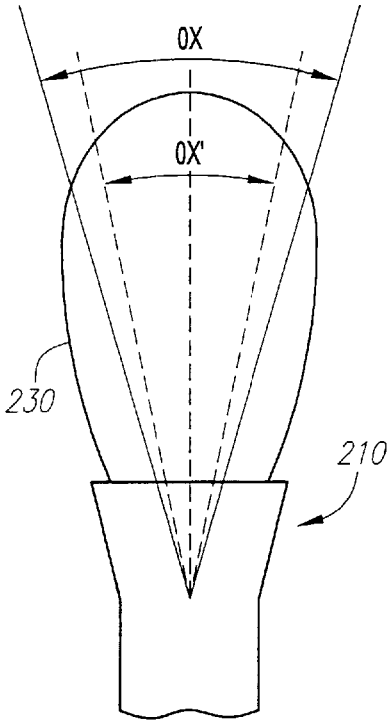
FIG. 14A is a cut-away side view of the feed horn of FIG. 13 showing a vertically polarized horn radiation gain pattern as measured along a vertical plane.
Figure 14B:
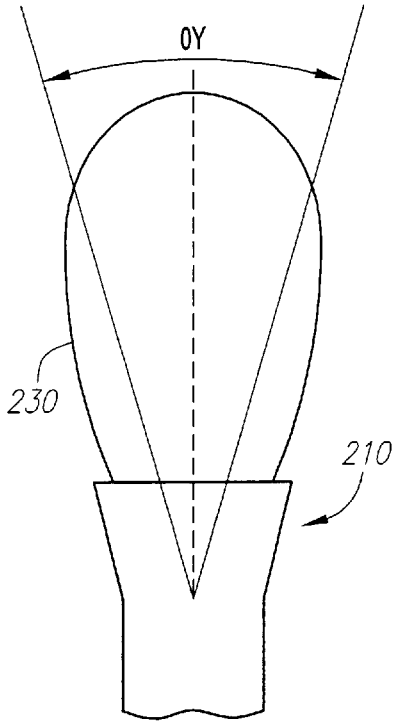
FIG. 14B is a cut-away side view of the feed horn of FIG. 13 showing a vertically polarized horn radiation gain pattern as measured along a horizontal plane.
Figure 15:
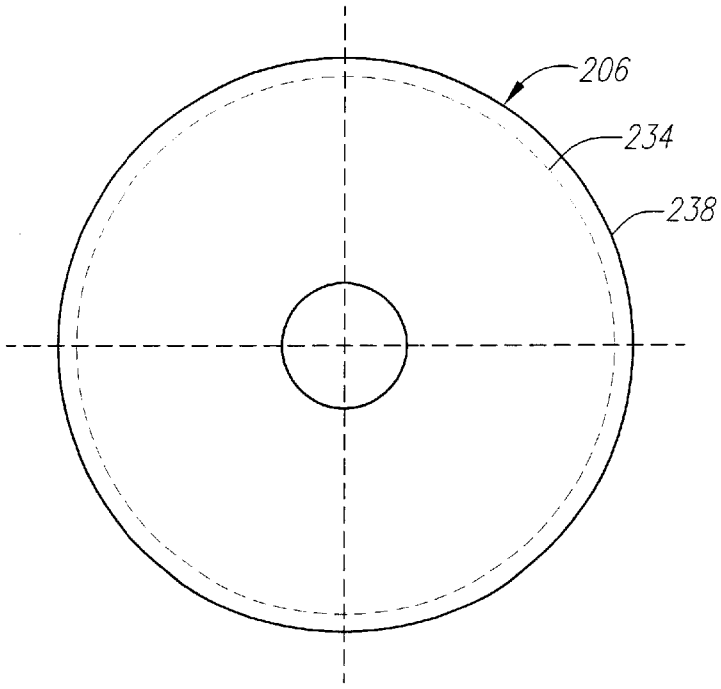
FIG. 15 is a top view of the reflector employed in the antenna of FIG. 11 showing a vertically polarized gain contour.

By adjusting the length of the elongate tab structures 226, the feed horn 210 can be designed to produce a vertically polarized horn radiation gain pattern 230 with equal beams widths (ΘX) and (ΘY) as measured in the respective vertical and horizontal planes (as depicted in FIGS. 14A and 14B). That is, the beam width (ΘX) can be increased from a beam width (ΘX') to match the beam width (ΘY) by increasing the length of the elongate tab structures 226. As depicted in FIG. 15, superposition of the gain pattern 230 onto the reflector 206 creates a vertically polarized gain contour 234, preferably approximately 20 dB below the peak, that is circularly symmetric. The gain contour 234 can thus be made to match a rim edge 238 of the reflector 206 by adjusting the size of the circular aperture 220, thereby providing an efficient antenna 200.

Figure 16:
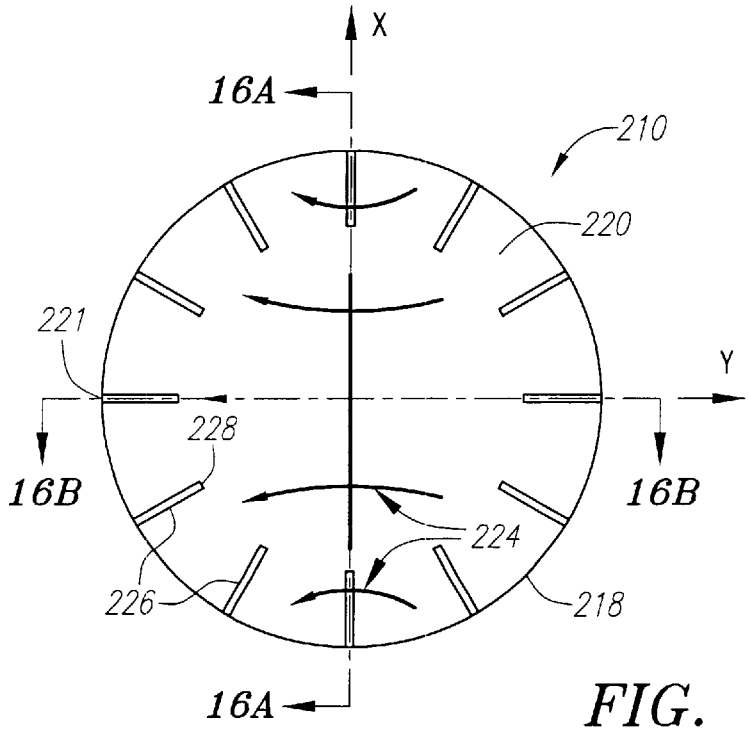
FIG. 16 is a top view of the feed horn of the antenna of FIG. 11 forming a circular aperture with a horizontally polarized E-field.
Figure 16A:
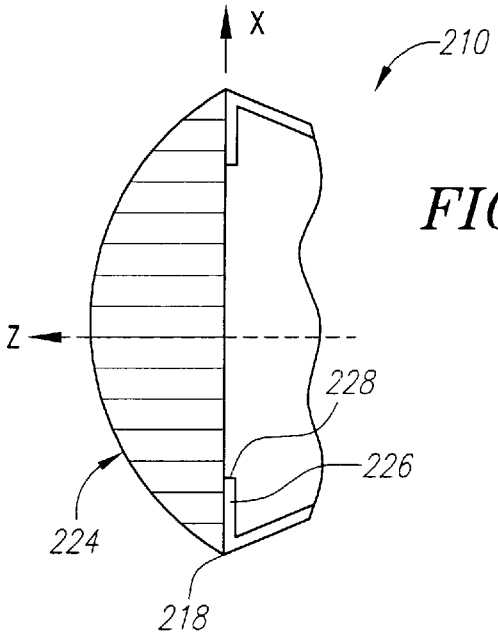
FIG. 16A is a partially cut-away side view of the feed horn of FIG. 16 showing the magnitude of the horizontally polarized E-field as measured along a vertical plane.
Figure 16B:
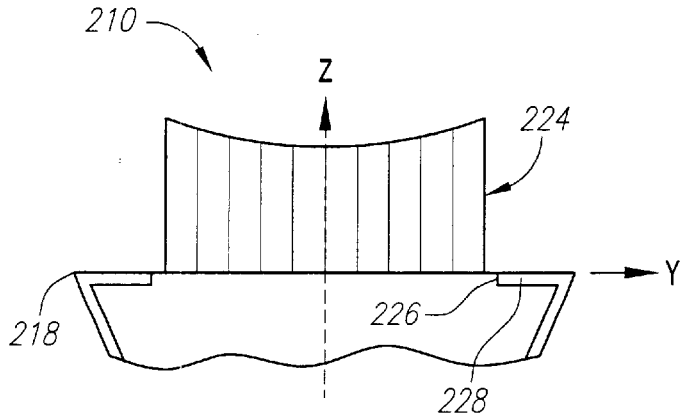
FIG. 16B is a partially cut-away side view of the feed horn of FIG. 16 showing the magnitude of the horizontally polarized E-field as measured along a horizontal plane.

FIG. 16 shows an E-field 224 created by the horizontally polarized signal 204, i.e., a horizontally polarized E-field 224. For ease of illustration, the circular aperture 220 is depicted as having respective orthogonal X-, Y- and Z-axes, with the X- and Y-axes being coplanar with the circular aperture 220 and the Z-axis being perpendicular to and passing through the center of the circular aperture 220. Contrary to the case of the vertically polarized E-field 222, the magnitude of the horizontally polarized E-fie(d 224 is peaked along the X-axis (vertical plane) at the Z-axis (depicted in FIG. 16A) but fairly uniform along the Y-axis (horizontal plane) (depicted in FIG. 16B).

The plurality of elongate tab structures 226 also differentially affect the horizontally polarized E-field 224. In particular, the horizontally polarized E-field 224 terminates on the tip 228 of the tab structure 226 adjacent the portions 221 of the edge 218 perpendicular to the E-field 224 (depicted in FIG. 16B), whereas the horizontally polarized E-field 224 terminates on the portions 219 of the edge 218 parallel to the E-field 224 (depicted in FIG. 16A). As such, the horizontally polarized E-field 224 along the horizontal plane terminates to full strength at the tab structure tips 228, rather than at the portions 221 of the edge 218. The horizontally polarized E-field 224 along the vertical plane, however, terminates to zero at the portions 219 of the edge 218. In this manner, although the aperture 220 is circularly symmetric, the effective diameters of the circular aperture 220 in the respective vertical and horizontal planes differ, i.e., the effective diameter of the circular aperture 220 in the horizontal plane is smaller than the effective diameter of the circular aperture 220 in the vertical plane with respect to the horizontally polarized E-field 224.

Figure 17A:
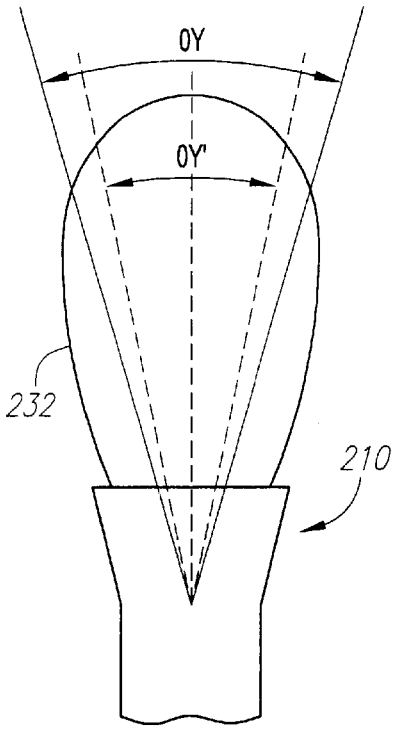
FIG. 17A is a cut-away side view of the feed horn of FIG. 16 showing a horizontally polarized horn radiation gain pattern as measured along a horizontal plane.
Figure 17B:
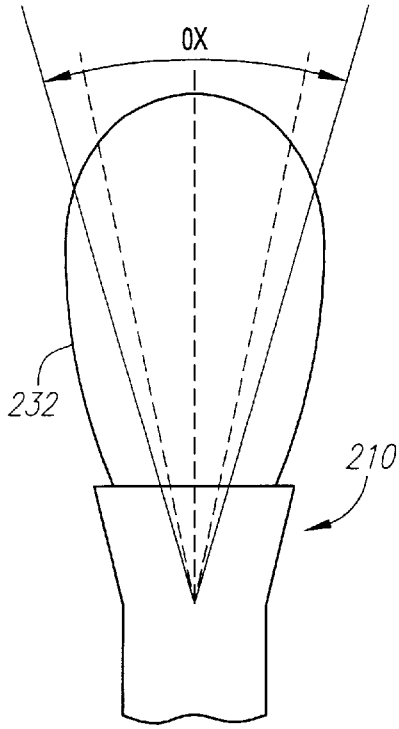
FIG. 17B is a cut-away side view of the feed horn of FIG. 16 showing a horizontally polarized horn radiation gain pattern as measured along a vertical plane.
Figure 18:
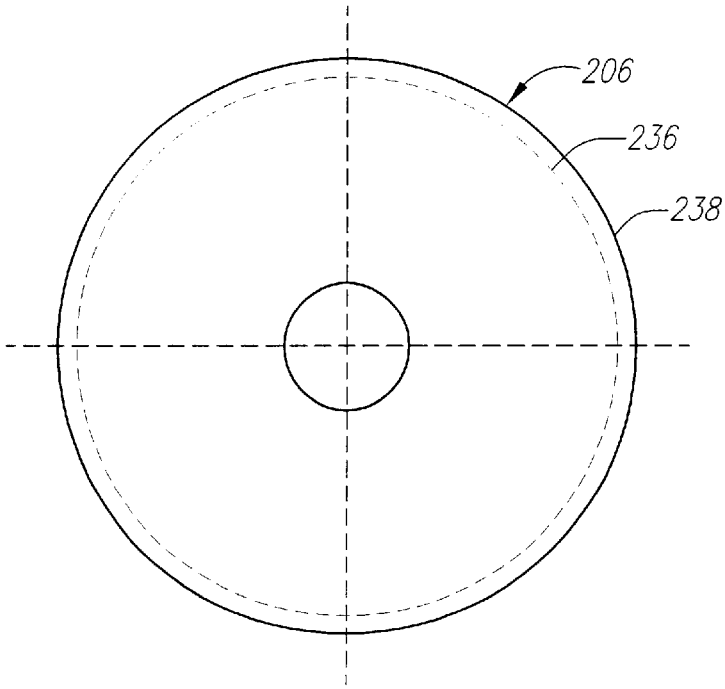
FIG. 18 is a top view of the reflector employed in the antenna of FIG. 11 showing a gain contour for a polarization defined as horizontal with respect to the Earth.

By adjusting the length of the elongate tab structures 226, the feed horn 210 can be designed to produce a horizontally polarized horn radiation gain pattern 232 with equal beams widths (ΘX) and (ΘY) as measured in the respective vertical and horizontal planes (as depicted in FIGS. 17A and 17B). That is, the beam width (ΘY) can be increased from a beam width (ΘY') to match the beam width (ΘX) by increasing the length of the elongate tab structures 226. As depicted in FIG. 18, superposition of the gain pattern 232 onto the reflector 206 creates a horizontally polarized gain contour 236, preferably approximately 20 dB from peak, that is circularly symmetric. The gain contour 236 can thus be made to match a rim edge 238 of the reflector 206 by adjusting the size of the circular aperture 220, thereby providing an efficient antenna 200.

Figure 19:
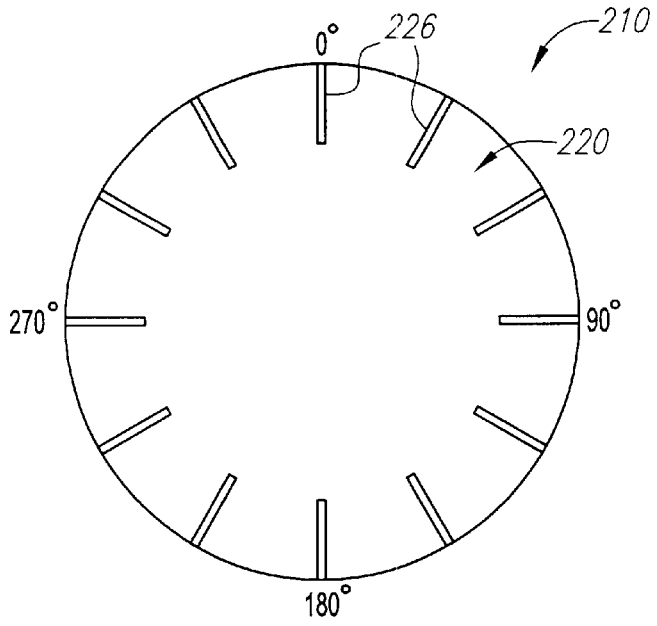
FIG. 19 is a top view of the feed horn of FIG. 16 particularly showing the arrangement of elongate tab structures.

The elongate tab structures 226 are preferably arranged around the circular aperture 220, such that the elongate tab structures 226 in relation to the vertical plane match the elongate tab structures 226 in relation to the horizontal plane. In this manner, the effect upon the vertically polarized E-field 222 will be similar to that upon the horizontally polarized E-field 224, thereby allowing the circular feed horn 210 to be designed to produce respective vertically and horizontally polarized gain contours 234 and 236 on the reflector 206 that are both circularly symmetric. For example, FIG. 19 depicts the circular aperture 220 divided into 90° sectors with the arrangement of elongate tab structures 226 being symmetrical about each 90° sector, i.e., the feed horn 210 has four identical sets of elongate tab structures 226 at the respective 0°–90, 90°–180°, 180°–270° and 270°–360° sectors.

The orthomode transducer 214 isolates and extracts the respective vertically and horizontally polarized signals 202 and 204 and comprises respective vertical and horizontal probes 238 and 240 extending from the waveguide 212. The vertical probe 238 comprises a wire aligned with the vertically polarized E-field to facilitate extraction of the vertically polarized signal 202. The horizontal probe 240 comprises a wire aligned with the horizontally polarized E-field to facilitate extraction of the horizontally polarized signal 204. The orthomode transducer 214 further includes coaxial connectors 242 and 244 respectively located at the bases of the vertical and horizontal probes 238 and 240 to facilitate transmission of the respective signals 202 and 204 through coaxial cables (not shown). It should be appreciated that the orthomode transducer 214 comprises any structure that allows for the respective extraction of vertically and horizontally polarized signals.

The length and thickness of the respective vertical and horizontal probes 238 and 240 are selected to best "match" the respective signals 202 and 204, i.e., extract the respective signals 202 and 204 with the minimum amount of reflections, thereby preventing loss of energy back out through the waveguide 212. This matching is aided by a septum 246 placed parallel to and approximately ¼ wavelength behind the vertical probe 238; and an endplate 248 placed parallel to and approximately ¼ wavelength behind the horizontal probe 240 ($\lambda$=c/f: where $\lambda$ is the wavelength, c is the propagation velocity in the waveguide 212 and f is the frequency). By using the septum 246, the horizontally polarized signal 204, which creates an E-field perpendicular to the septum 246, is not affected and passes by the vertical probe 238 and the septum 246 towards the horizontal probe 240 and endplate 248. The horizontally polarized signal 204, which creates an E-field parallel to the endplate 248, is extracted by the horizontal probe 240. The vertically polarized signal 202, which creates an E-field parallel to the septum 246, is extracted by the vertical probe 238.

To further improve the efficiency of the feed assembly 208, the feed assembly 208 includes a electrical conductor 249 disposed collinear with the axis 215 of the feed assembly 208. In particular, the electrical conductor 249 is a cylindrical rod mounted to the endplate 248. In this manner, unwanted reflections that may couple energy from one polarization to another (cross-coupling) or may channel energy back out the feed (reflections) instead of guiding energy out through the orthomode transducer, or minimized.

Figure 20:
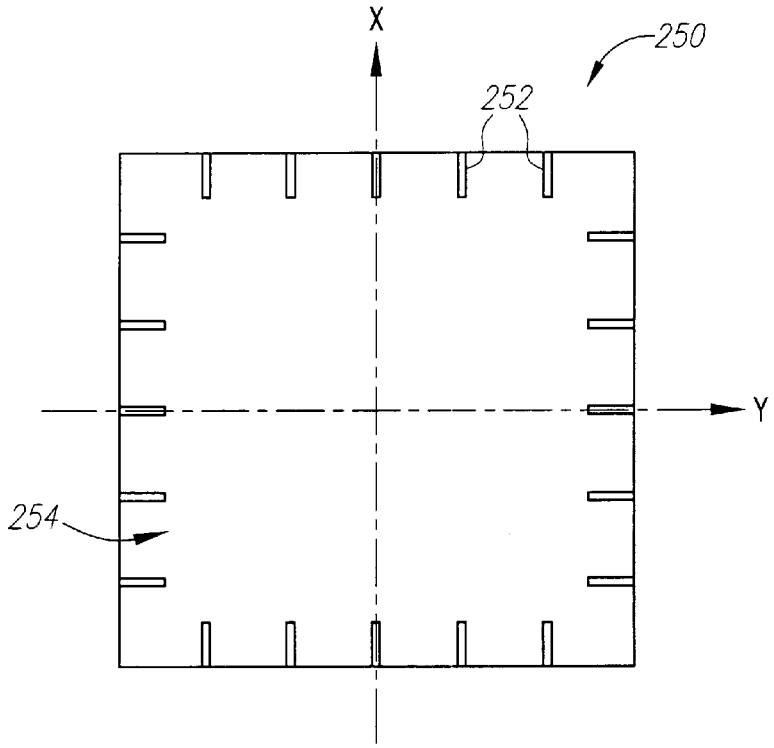
FIG. 20 is a top view of a square feed horn particularly showing the arrangement of elongate tab structures.

The present invention can be applied to feed horns other than circular feed horns. For instance, FIG. 20 depicts a rectangular feed horn 250, which employs a plurality of elongate tab structures 252 to E-fields in a square aperture 254. The elongate tab structures 252 in relation to the X-axis matches the elongate tab structures 252 in relation to the Y-axis. The length of the elongate tab structures 252 and size of the aperture 254 can be adjusted to provide an efficient antenna similar to that described above.

Figure 21:
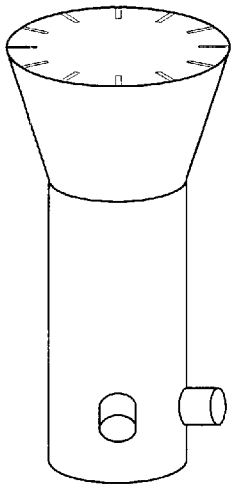
FIG. 21 is a horn antenna, which can employ the tab structures of FIG. 16.
Figure 22:
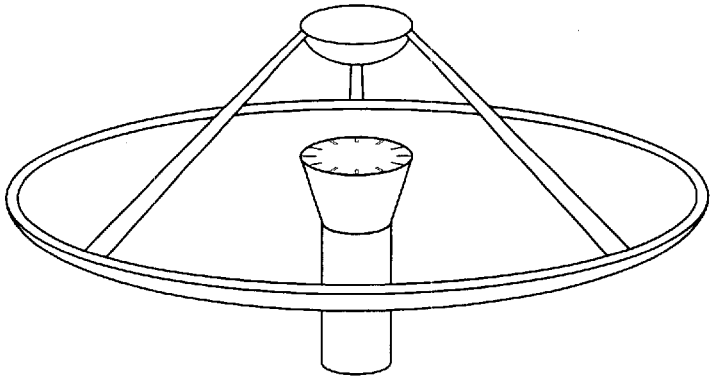
FIG. 22 is a Cassegrain feed antenna, which can employ the circular feed horn of FIG. 16.
Figure 23:
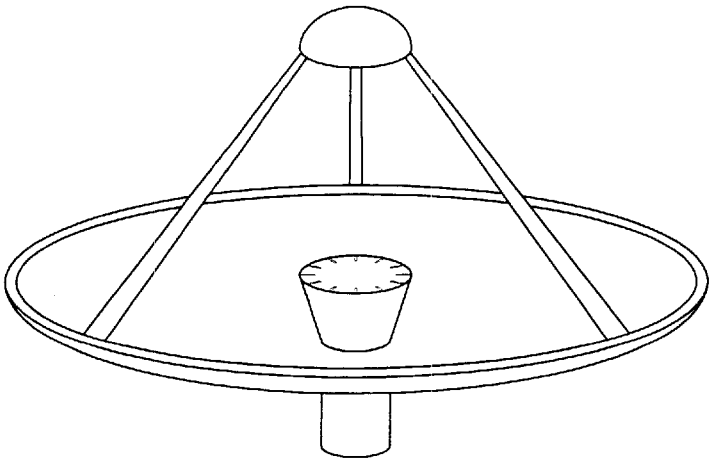
FIG. 23 is a Gregorian feed antenna, which can employ the circular feed horn of FIG. 16.

The present invention can also be applied to antennas other than the Newtonian feed antenna system 200 described above. For example, a circular feed horn similar to the circular feed horn 210 described above can be employed in a feed antenna (depicted in FIG. 21), Cassegrain feed antenna (depicted in FIG. 22) or a Gregorian feed antenna (depicted in FIG. 23), with similar results.

Figure 9:
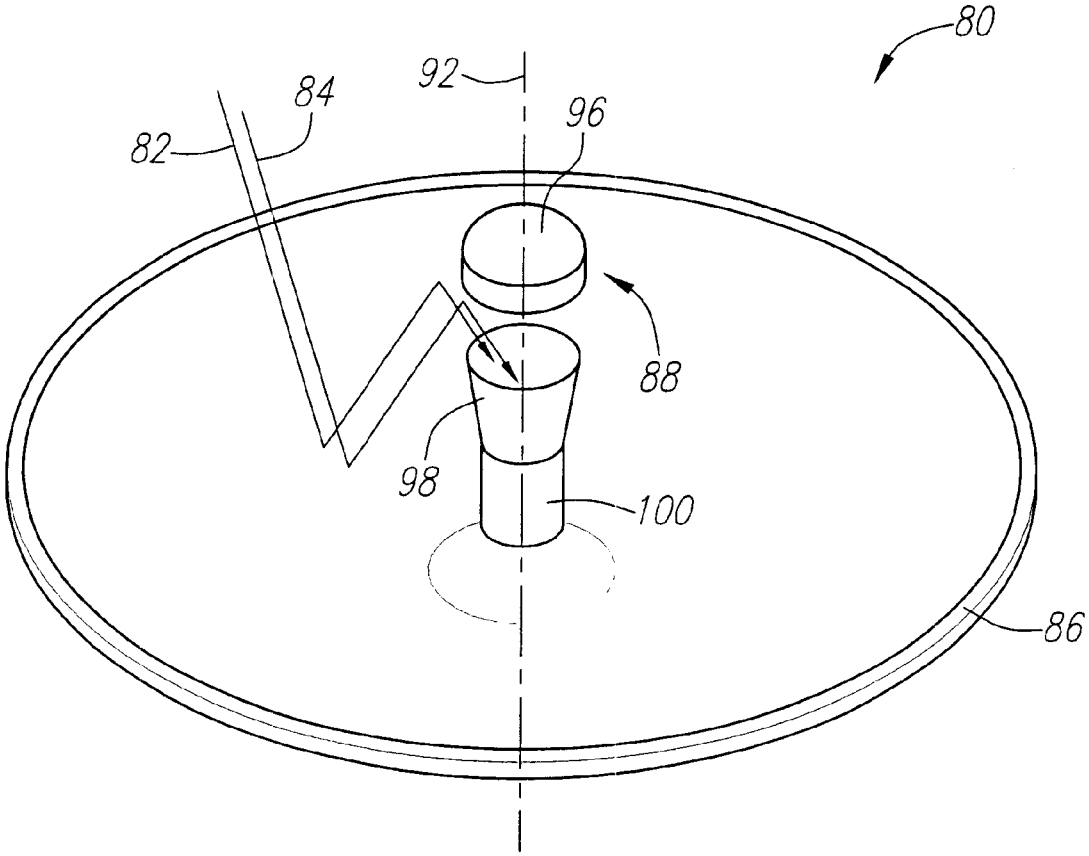
FIG. 9 (PRIOR ART)
FIG. 9 is a perspective view of a prior art receiving with "splash plate" feed.
Figure 24:
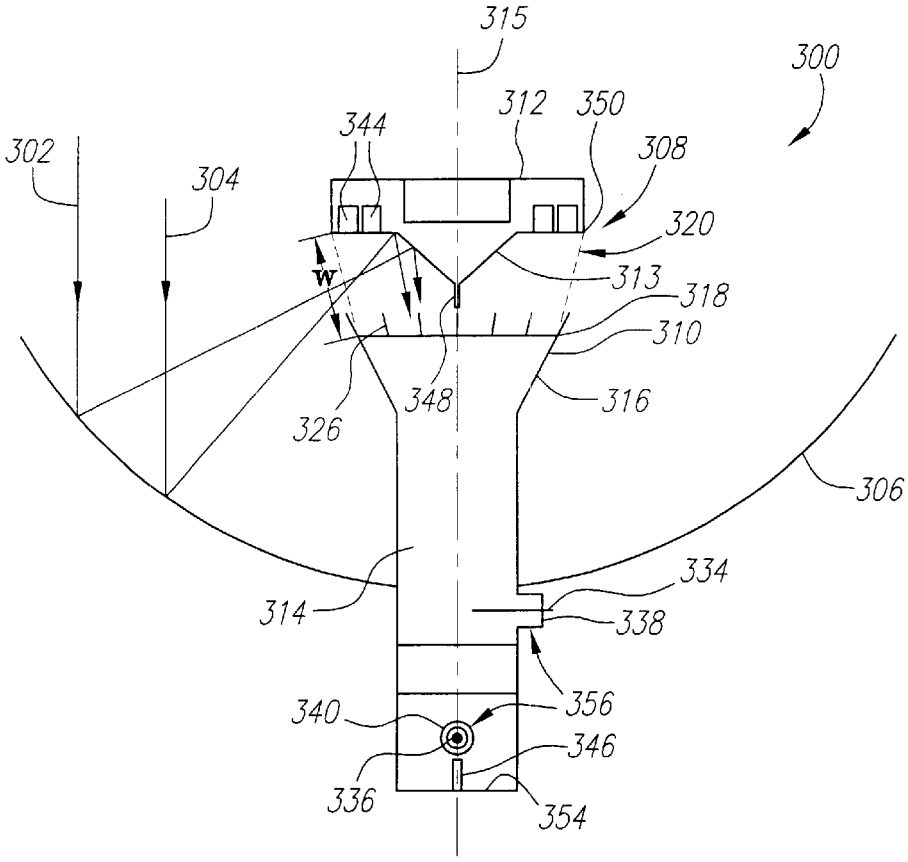
FIG. 24 is a cut-away side view of a splash plate feed antenna constructed in accordance with the present invention.
Figure 25:
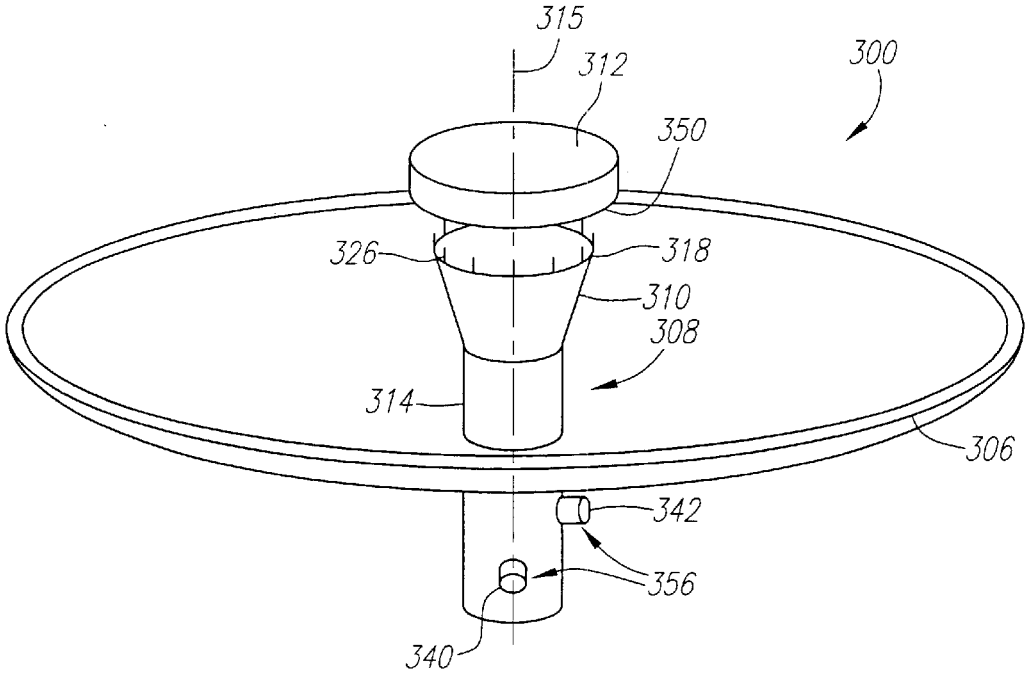
FIG. 25 is a perspective view of the splash plate feed antenna of FIG. 24.

Referring to FIGS. 24 and 25, a "splash plate" feed antenna system 300 designed in accordance with a preferred embodiment of the present invention is described. Like the antenna system 80 depicted in FIG. 9, the antenna system 300 is configured to receive respective polarized signals 302 and 304, and in this case, respective vertically and horizontally linear polarized signals. The antenna system 300 generally includes a ring focus parabolic reflector 306 and a feed assembly 308 having a circular feed horn 310, secondary reflector ("splash plate") 312 with a conical structure 313, circular waveguide 314 and orthomode transducer 356. The reflector 306, feed horn 310, splash plate 312 and waveguide 314 are all circularly symmetrical about an antenna axis 315. As such, the antenna system 300 will guide all polarizations in the same manner, whether vertical and horizontal linearly polarized or right-hand and left-hand circularly polarized.

Figure 10:
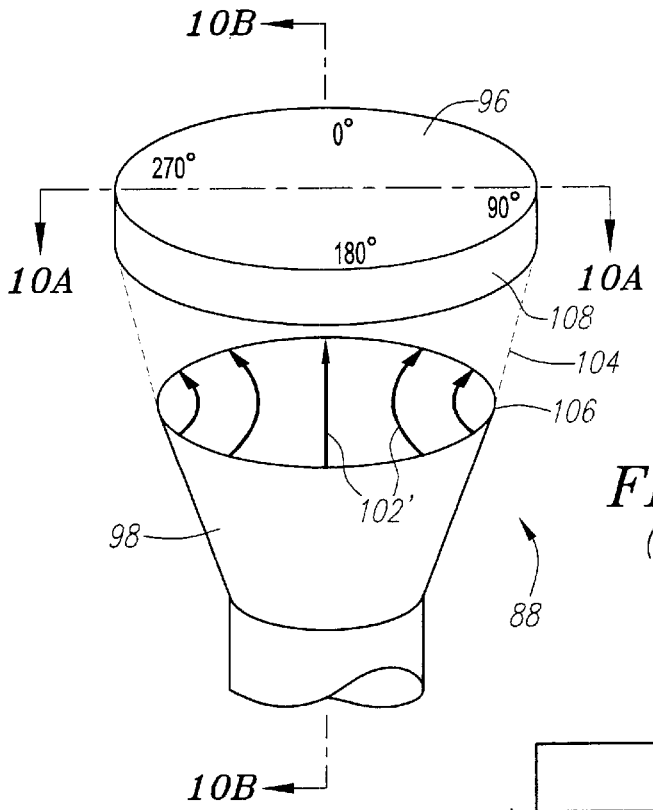
FIG. 10 (PRIOR ART)
FIG. 10 is a partially cut-away perspective view of a prior art horn assembly employing a feed horn and a splash plate to form an annular aperture with E-field linearly polarized normal to the system axis.
Figure 10A:
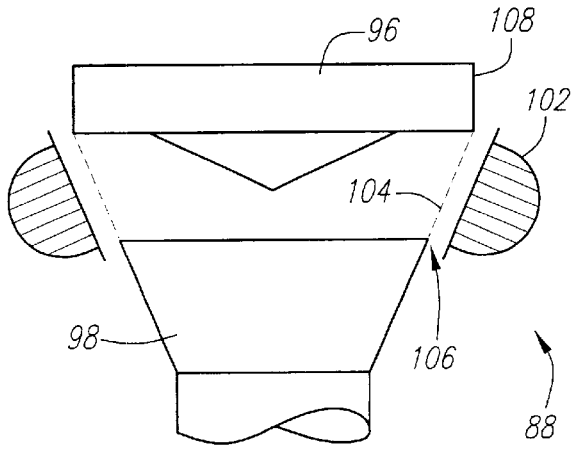
FIG. 10A (PRIOR ART)
FIG. 10A is a partially cut-away side view of the feed horn assembly of FIG. 10 showing the magnitude of the linearly polarized E-field as measured along the annular aperture gap orthogonal to the plane of polarization.
Figure 10B:
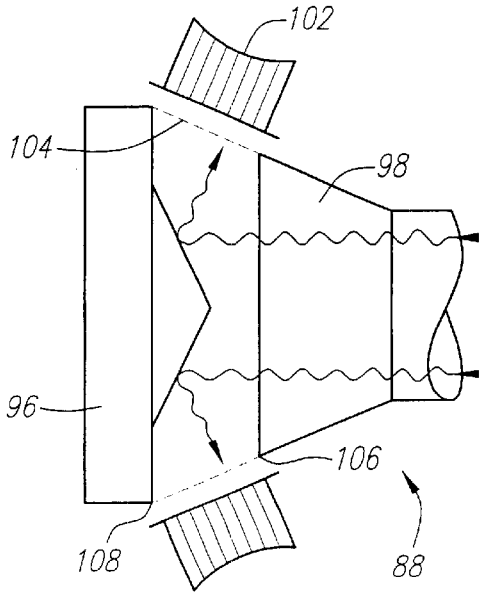
FIG. 10B (PRIOR ART)
FIG. 10B is a partially cut-away side view of the feed horn assembly of FIG. 10 showing the magnitude of the linearly polarized E-field as measured along the annular aperture gap in the plane of polarization.
Figure 26:
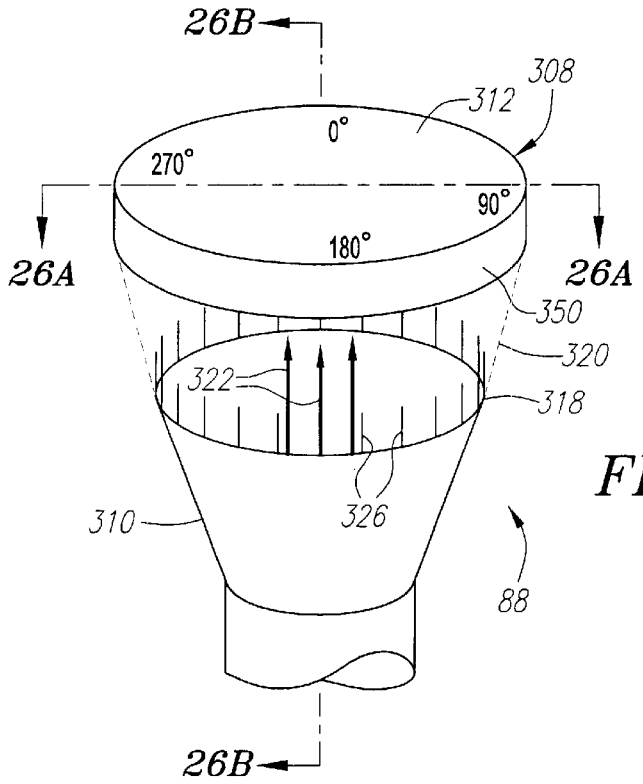
FIG. 26 is a perspective view of an antenna feed horn assembly employed in the antenna of FIG. 25 and including a feed horn and a splash plate to form an annular aperture from which RF energy radiates with an E-field polarized predominantly parallel to the assembly axis.
Figure 26A:
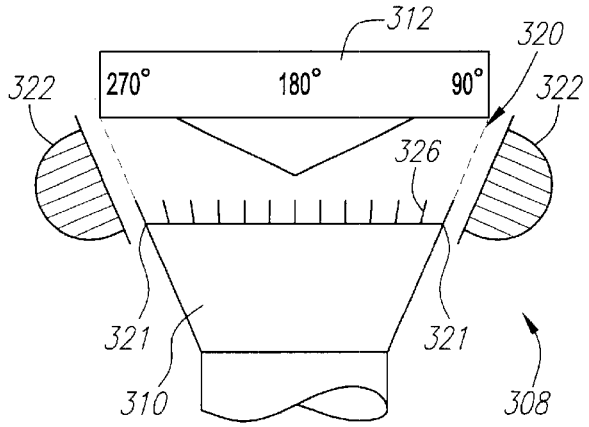
FIG. 26A is a partially cut-away side view of the antenna feed horn assembly of FIG. 26 showing the magnitude of the E-field polarized predominantly parallel to the system axis in a plane containing the system axis in the 90°/270° orientation.
Figure 26B:
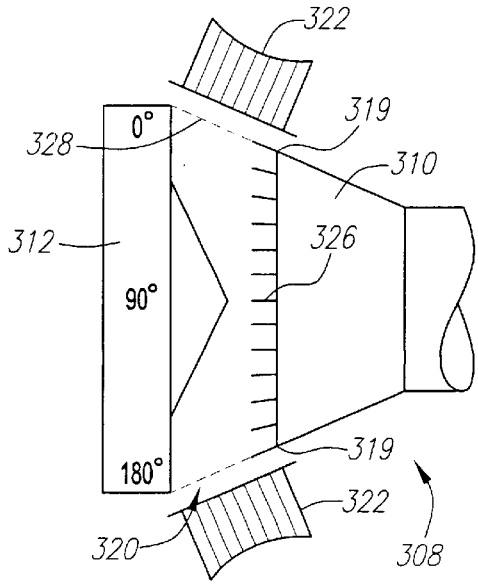
FIG. 26B is a partially cut-away side view of the antenna feed horn assembly of FIG. 26 showing the magnitude of the E-field polarized predominantly parallel to the system axis in a plane containing the system axis in the 0°/180° orientation.

The feed horn 310 generally includes an electrically conducting conical wall 316 with an edge 318. The splash plate 312 is generally circular and includes an edge 350. Formed between the respective edges 318 and 350 is an annular aperture 320 with a width (w) through which the respective signals 302 and 304 travel. FIG. 26 shows an electrical field ("E-field") 322 created by the vertically polarized signal 302, i.e., a vertically polarized E-field. For ease of illustration, the annular aperture 320 is depicted as having an axis of revolution around which the angles 0°, 90°, 180° and 270° are labeled. Like the vertically polarized E-field 102 shown in the prior art feed horn aperture 104 of FIG. 10, the magnitude of the vertically polarized E-field 322 is fairly uniform along the boundary of the annular aperture 320 at the 0° and 180° locations (depicted in FIG. 26A) (horizontal plane) and peaked along the boundary of the annular aperture 320 at the 0° and 180° locations (depicted in FIG. 26B) (vertical plane).

The feed horn 310, however, further includes a plurality of electrical conductors 326, and in particular elongate tab structures, which extend from the feed horn edge 318 towards the splash plate edge 350 in a coplanar relationship with the annular aperture 320, with the elongate tab structures 326 differentially affecting the vertically polarized E-field 322. In particular, the vertically polarized E-field 322 terminates on a tip 328 of a tab structure 326 adjacent portions 319 of the feed horn edge 318 perpendicular to the E-field 322 (depicted in FIG. 26B), whereas the vertically polarized E-field 322 terminates on portions 321 of the feed horn edge 318 parallel to the E-field 322 (depicted in FIG. 26A). As such, the vertically polarized E-field 222 along the vertical plane terminates to full strength at the tab structure tips 328, rather than at the portions 319 of the feed horn edge 318. The vertically polarized E-field 322 along the horizontal plane, however, terminates to zero at the portions 321 of the feed horn edge 318. In this manner, although the aperture 320 is annularly symmetric, the effective width (w) of the annular aperture 320 in the respective vertical and horizontal planes differ, i.e., the effective width (w) of the annular 320 in the vertical plane is smaller than the effective width (w) of the annular aperture 320 in the horizontal plane with respect to the vertically polarized E-field 322.

Figure 27A:
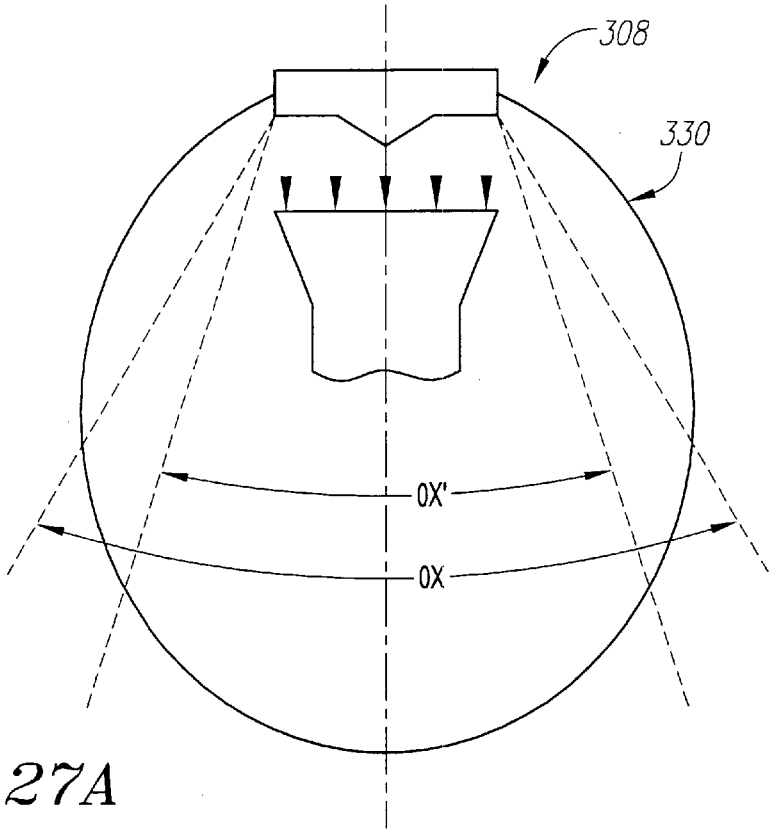
FIG. 27A is a partially cut-away side view of the antenna feed horn assembly of FIG. 26 showing a vertically polarized horn radiation gain pattern as measured in the 90°/270° orientation.
Figure 27B:
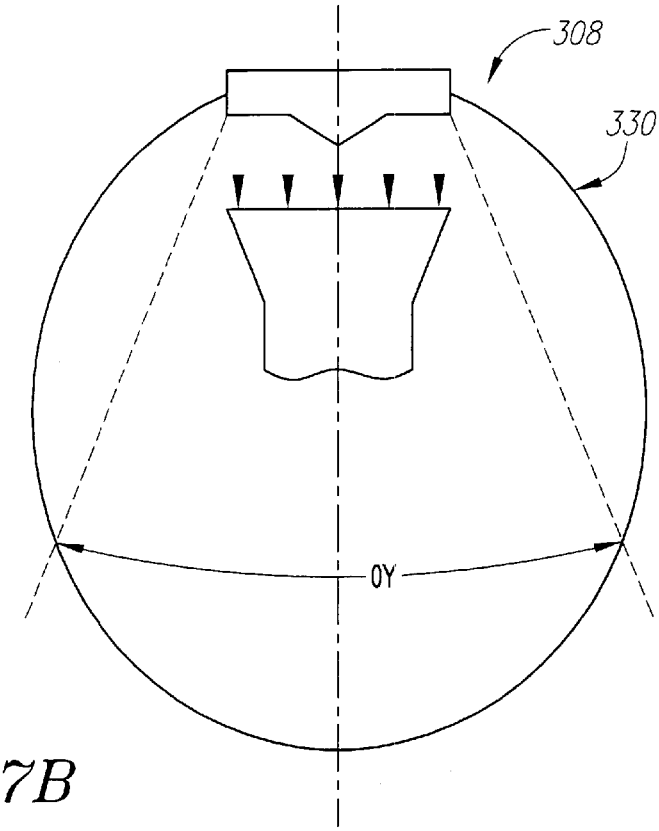
FIG. 27B is a partially cut-away side view of the antenna feed horn assembly of FIG. 26 showing a vertically polarized horn radiation gain pattern as measured in the 0°/180° orientation.

By adjusting the length of the elongate tab structures 326, the feed horn 310 can be designed to produce a vertically polarized horn radiation gain pattern 330 with equal beams widths (ΘX) and (ΘY) as measured in the respective vertical and horizontal planes (as depicted in FIGS. 27A and 27B). That is, the beam width (ΘX) can be increased from a beam width (ΘX') to match the beam width (ΘY) by increasing the length of the elongate tab structures 326. Superposition of the gain pattern 330 onto the reflector 306 creates a vertically polarized gain contour similar to that depicted in FIG. with respect to the antenna 200.

Figure 28:
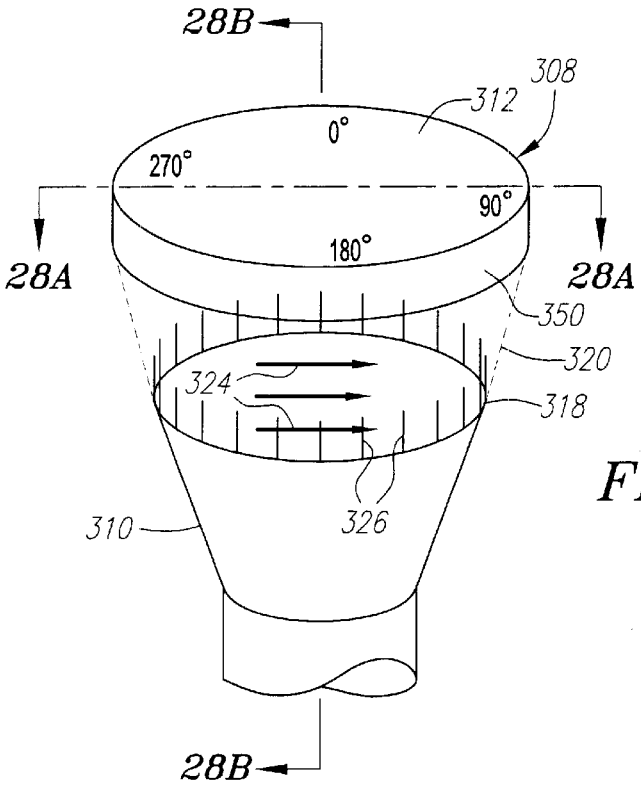
FIG. 28 is a partially cut-away perspective view of a feed horn assembly employed in the antenna of FIG. 25 and including a feed horn and a splash plate to form an annular aperture with an E-field polarized substantially crosswise to the assembly axis in the 90°/270° orientation.
Figure 28A:
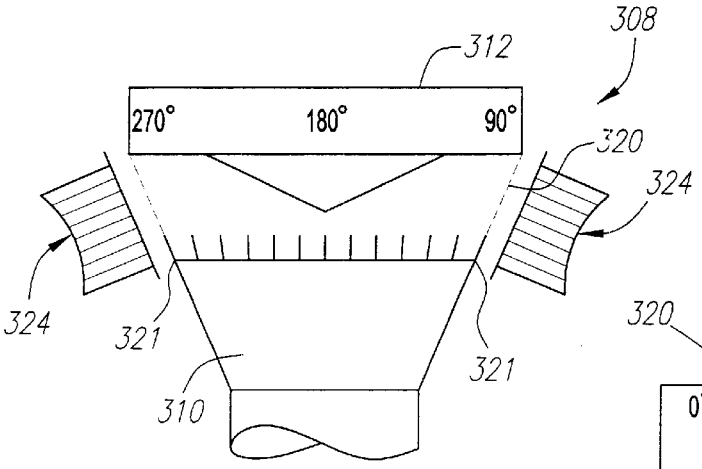
FIG. 28A is a partially cut-away side view of the feed horn assembly of FIG. 28 showing the magnitude of the horizontally polarized E-field as measured in the 90°/270° orientation.
Figure 28B:
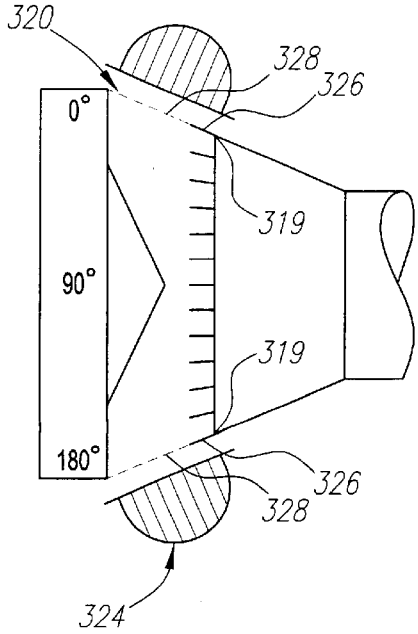
FIG. 28B is a partially cut-away side view of the feed horn assembly of FIG. 28 showing the magnitude of the horizontally polarized E-field as measured in the 0°/180° orientation.

FIG. 28 shows an electrical field ("E-field") 324 created by the horizontally polarized signal 302, i.e., a horizontally polarized E-field. For ease of illustration, the annular aperture 320 is depicted as having an axis of revolution around which the angles 0°, 90°, 180° and 270° are labeled. Contrary to the vertically polarized E-field 322, the magnitude of the horizontally polarized E-field 324 is fairly uniform along the boundary of the annular aperture 320 at the 90° and 270° locations (depicted in FIG. 28A) (horizontal plane) and peaked along the boundary of the annular aperture 320 at the 0° and 180° locations (vertical plane) (depicted in FIG. 28B).

The plurality of elongate tab structures 326 also differentially affect the horizontally polarized E-field 324. In particular, the horizontally polarized E-field 324 terminates on the tip 328 of the tab structure 326 adjacent portions 321 of the feed horn edge 318 perpendicular to the E-field 322 (depicted in FIG. 28A), whereas the horizontally polarized E-field 324 terminates on the portions 319 of the feed horn edge 318 parallel to the E-field 324 (depicted in FIG. 28B). As such, the horizontally polarized E-field 324 along the horizontal plane terminate to full strength at the tab structure tips 328, rather than at the portions 321 of the feed horn edge 318. The horizontally polarized E-field 324 along the vertical plane, however, terminates to zero at the portions 319 of the feed horn edge 318. In this manner, although the aperture 320 is annularly symmetric, the effective width (w) of the annular aperture 320 in the respective vertical and horizontal planes differ, i.e., the effective width (w) of the annular 320 in the horizontal plane is smaller than the effective width (w) of the annular aperture 320 in the vertical plane with respect to the horizontally polarized E-field 324.

Figure 29A:
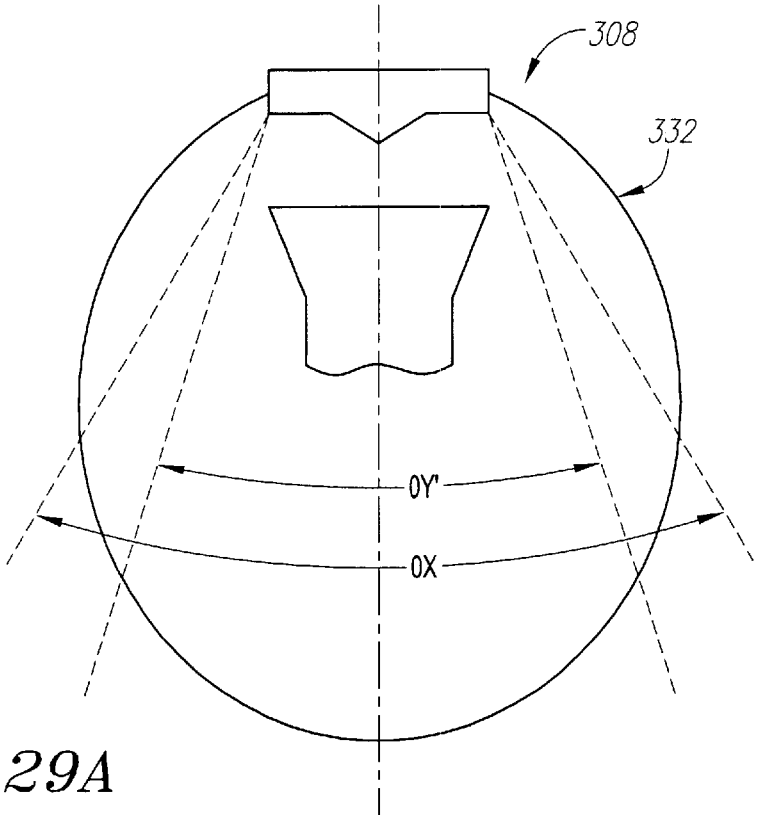
FIG. 29A is a partially cut-away side view of the antenna feed horn assembly of FIG. 28 showing a horn radiation gain pattern as measured in the 90°/270° orientation.
Figure 29B:
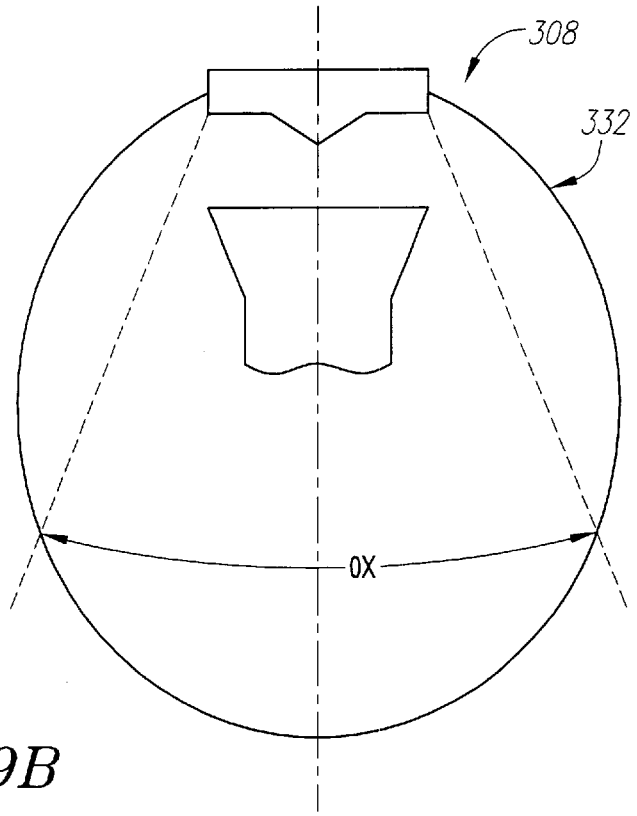
FIG. 29B is a partially cut-away side view of the antenna feed horn assembly of FIG. 28 showing a horn radiation gain pattern as measured in the 0°/180° orientation.

By adjusting the length of the elongate tab structures 326, the feed horn 310 can be designed to produce a horizontally polarized horn radiation gain pattern 332 with equal beams widths (ΘX) and (ΘY) as measured in the respective vertical and horizontal planes (as depicted in FIGS. 29A and 29B). That is, the beam width (ΘY) can be increased from a beam width (ΘY') to match the beam width (ΘX) by increasing the length of the elongate tab structures 326. Superposition of the gain pattern 332 onto the reflector 306 creates a horizontally polarized gain contour similar to that depicted in FIG. 18 with respect to the antenna 200.

The elongate tab structures 326 are preferably arranged around the annular aperture 320, such that the elongate tab structures 326 in relation to the vertical plane match the elongate tab structures 326 in relation to the horizontal plane. In this manner, the effect upon the vertically polarized E-field 322 will be similar to that upon the horizontally polarized E-field 324, thereby allowing the feed assembly 308 to be designed to produce respective vertically and horizontally polarized gain contours on the reflector 306 that are both circularly symmetric. For example, similar to the circular aperture depicted in FIG. 19, the arrangement of elongate tab structures 326 are symmetrical about each 90° sector, i.e., the feed horn 310 has four identical sets of elongate tab structures 326 at the respective 0°–90, 90°–180°, 180°–270° and 270°–360° sectors.

Figure 30:
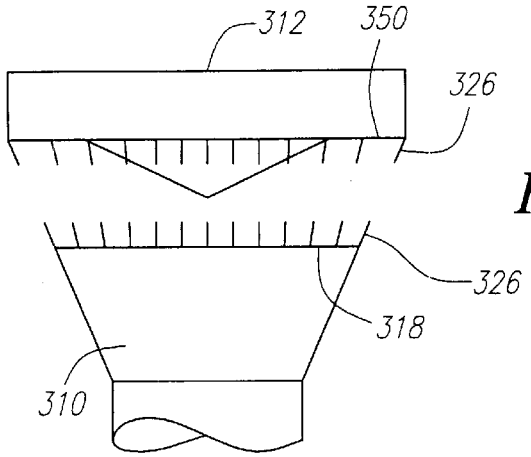
FIG. 30 is a partially cut-away side view of another feed assembly employed in the antenna of FIG. 25.

Alternatively, the plurality of elongate tab structures 326 extend from the splash plate edge 350 toward the feed horn edge 318 in a coplanar relationship with the annular aperture 320, either solely or in conjunction with the plurality of elongate tab structures 326 extending from the feed horn edge 316 (as depicted in FIG. 30) with similar results.

As with the orthomode transducer 214 of the antenna 200, the orthomode transducer 356 includes respective vertical and horizontal probes 334 and 336 extending from the waveguide 314 to isolate and extract the respective vertically and horizontally polarized signals 302 and 304 for transmission thereof through coaxial cables (not shown) via respective coaxial connectors 338 and 340. The orthomode transducer 356 also includes a septum 342 and an endplate 354 to facilitate respective matching of the probes 334 and 336 with the signals 302 and 304. The splash plate 312 includes a set of annular chokes 344 approximately ¼ wavelength deep, which channel out around the perimeter of the splash plate 312. The annular chokes 344 serve to prevent loss of energy due to extraneous currents being excited on the splash plate 312.

To further improve the efficiency of the feed assembly 308, the feed assembly 308 includes first and second electrical conductors 346 and 348 disposed collinear with the axis 315. In particular, the electrical conductors 346 and 348 are cylindrical rods respectively mounted to the endplate 354 and the center of the conical structure 313 of the splash plate 312. In this manner, unwanted reflections that may couple energy from one polarization to another (cross-coupling) or may channel energy back out the feed (reflections) instead of guiding energy out through the orthomode transducer, are minimized.

Figure 31:
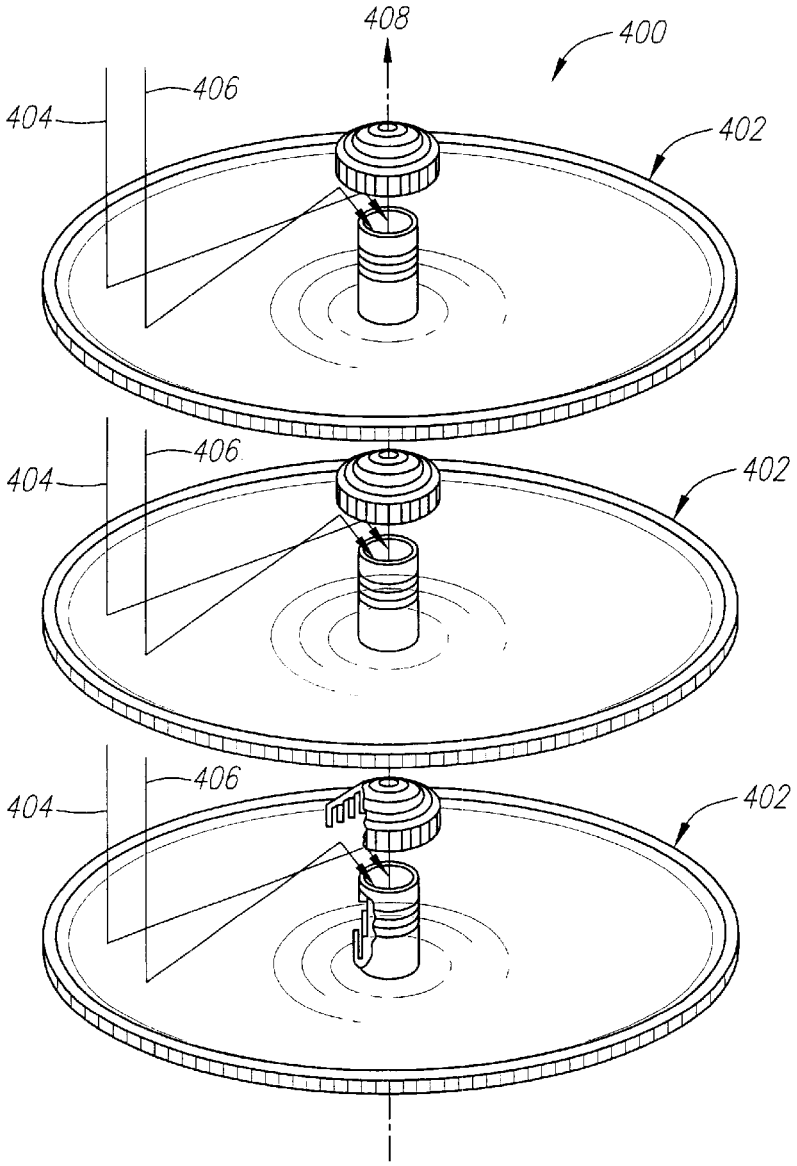
FIG. 31 is a perspective view of an antenna array for cancellation of interference from satellites nearby in the synchronous satellite orbit constructed in accordance with the present invention.

Referring to FIG. 31, a noise cancellation antenna array 400 designed in accordance with another preferred embodiment of the present invention is described. The antenna array 400 includes three small antennas 402, each of which are similar to the antenna system 200 or antenna system 300 described above. The antennas 402 are configured to receive respective vertically and horizontally polarized signals 404 and 406. The respective antennas 402 can be attached together, as depicted in FIG. 32, to form a combined aperture antenna that produces a particular combined antenna radiation sensitivity pattern. Such an application is described in further detail in Lusignan, U.S. Pat. No. 5,745,084 and copending application Ser. No. 08/259,980 filed Jun. 17, 1994, which has been previously incorporated herein by reference.

The antenna beam in this application, which is formed by properly combining the energy from the three antennas 402, has a high gain in the direction of an antenna axis 408, which would be pointed at a geosynchronous communications satellite operating in the C-Band (4 GHz) microwave frequency. At the same time the fields from the three antennas 402 combine in such a manner as to cause nulls in the direction of potential interfering satellites at +2°, +4°, +6°, and −2°, 4°, −6° from the desired satellite in the synchronous orbit. In this manner, small antennas can be utilized in the direct to the home (DTH) markets. Based on the results measured with the antenna depicted in FIG. 25, the antenna array 400 can support twice as many television channels with the employment of the elongate tab structures.

The particular antennas 200, 300 and 400 provide examples of the present invention in particular applications. It is evident, however, that there is a multiplicity of tab lengths and arrangements that will accomplish similar results. Other solutions, can be found by experiment by attaching the elongate tab structures on a feed horn and/or splash plate and measuring the distribution of energy on the reflector surface and the shape of the far field radiation gain pattern in respective horizontal and vertical planes for both horizontally and vertically polarized signals. If the reflector and the desired antenna radiation gain pattern are circular, then the most easily realized solution is to arrange the elongate tab structures as depicted above. If the reflector and the desired antenna radiation gain pattern are elliptical, then the above described tab structure arrangement may not be optimum. In such a case, a two-section symmetrical arrangement, i.e., 0°–180° and 180°–360°, might be employed to improve the antenna efficiency. The present invention is not limited to any particular frequency and would be useful in any frequency band, whether used to receive and/or transmit one or more polarized signals.

While the embodiments, applications and advantages of the present invention have been depicted and described, there are many more embodiments, applications and advantages possible without deviating from the spirit of the inventive concepts described herein. Thus, the inventions are not to be restricted to the preferred embodiments, specification or drawings. The protection to be afforded this patent should therefore only be restricted in accordance with the spirit and intended scope of the following claims.

What is claimed is:

1. An antenna feed horn assembly, comprising:

a circularly symmetric feed horn structure defining a circular aperture, wherein the feed horn structure includes an end opposite the circular aperture;

a circularly symmetric splash plate disposed above the circular aperture, such that a longitudinal axis passing through a center of the circular aperture substantially passes through a center of the splash plate;

a first electrical conductor disposed along the longitudinal axis, the first electrical conductor having two ends wherein, one of the two ends of the first electrical conductor is mounted to the center of the splash plate and the other end of the electrical conductor is an open end; and a second conductor, wherein the second conductor extends from the end towards the circular aperture;

wherein the end of the feed horn structure defines an endplate, and wherein the second conductor extends from a center of the end plate towards a center of the circular aperture.

2. An antenna feed horn assembly, comprising:

a circularly symmetric feed horn structure defining a circular aperture;

a circularly symmetric splash plate disposed above the circular aperture, such that a longitudinal axis passing through a center of the circular aperture substantially passes through a center of the splash plate;

a first electrical conductor disposed along the longitudinal axis; and a second electrical conductor disposed along the longitudinal axis, the second electrical conductor having two ends wherein, one of the two ends of the second electrical conductor is mounted to the center of the splash plate and the other end of the electrical conductor is an open end;

wherein the end of the feed horn structure defines an endplate, and wherein the first conductor extends from a center of the endplate towards a center of the circular aperture and the second conductor extends from the center of the splash plate towards the center of the endplate.

3. An antenna feed horn assembly, comprising:

a circularly symmetric feed horn structure defining a circular aperture;

a circular symmetric splash plate disposed above the circular aperture, such that a longitudinal axis passing through a center of the circular aperture substantially passes through a center of the splash plate;

a circular symmetric waveguide mounted to a base of the feed horn, the waveguide including a circular endplate opposite the circular aperture;

a first conductive rod having two ends, wherein one of the two ends of the first conductive rod is mounted to the endplate and the other end of the first conductive rod is an open end; and a second conductive rod having two ends, wherein one of the two ends of the second conductive rod is mounted to the center of the splash plate and the other end of the second conductive rod is an open end.

4. The Antenna feed horn assembly of claim 3, wherein the first and second conductive rods are dimensioned to prevent unwanted reflections within the feed horn structure.

* * * * *